US008044927B2

(12) United States Patent
Inoue

(10) Patent No.: US 8,044,927 B2
(45) Date of Patent: Oct. 25, 2011

(54) DRIVE METHOD FOR A DISPLAY DEVICE, DRIVE DEVICE, DISPLAY DEVICE, AND ELECTRONIC DEVICE

(75) Inventor: Katsutoyo Inoue, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 940 days.

(21) Appl. No.: 12/021,485

(22) Filed: Jan. 29, 2008

(65) Prior Publication Data

US 2008/0211833 A1 Sep. 4, 2008

(30) Foreign Application Priority Data

Jan. 29, 2007 (JP) ..... 2007-018424
Sep. 25, 2007 (JP) ..... 2007-247207

(51) Int. Cl.
*G09G 3/34* (2006.01)

(52) U.S. Cl. ..... 345/107; 345/105

(58) Field of Classification Search ..... 345/105–107, 345/48–49, 84; 359/296–297; 430/32–38
See application file for complete search history.

(56) References Cited

U.S. PATENT DOCUMENTS

| | | | | |
|---|---|---|---|---|
| 7,233,429 | B2 * | 6/2007 | Liang et al. | 359/296 |
| 7,715,087 | B2 * | 5/2010 | Hou et al. | 359/296 |
| 7,804,483 | B2 * | 9/2010 | Zhou et al. | 345/107 |
| 2002/0167480 | A1 * | 11/2002 | Johnson et al. | 345/107 |
| 2004/0032391 | A1 * | 2/2004 | Liang et al. | 345/107 |
| 2007/0075963 | A1 * | 4/2007 | Zhou et al. | 345/107 |
| 2007/0091418 | A1 * | 4/2007 | Danner et al. | 359/296 |
| 2007/0126694 | A1 * | 6/2007 | Moriyama et al. | 345/107 |
| 2007/0146306 | A1 * | 6/2007 | Johnson et al. | 345/107 |

FOREIGN PATENT DOCUMENTS

| | | | |
|---|---|---|---|
| JP | 8-68875 | A | 3/1996 |
| JP | 2006-267982 | A | 10/2006 |
| JP | 2007-57274 | A | 3/2007 |
| JP | 2007-57292 | A | 3/2007 |
| KR | 1020050092782 | A | 9/2005 |
| KR | 1020070007298 | A | 1/2007 |
| WO | 03079323 | A1 | 9/2003 |
| WO | 2004036305 | A1 | 4/2004 |
| WO | 2004066257 | A1 | 8/2004 |
| WO | 2005040908 | A1 | 5/2005 |
| WO | 2005088603 | A2 | 9/2005 |
| WO | 2006013502 | A1 | 2/2006 |

OTHER PUBLICATIONS

Richard M. Webber, et al, "10.4: Image Stability in Active-Matrix Microencapsulated Electrophoretic Displays", 2002 SID International Symposium—May 21, 2002, Hynes Convention Center, Boston, Massachusetts, vol. XXXIII, May 21, 2002, p. 126-129, XP007007923.

* cited by examiner

*Primary Examiner* — Alexander Eisen
*Assistant Examiner* — Nelson Lam

(57) ABSTRACT

A drive method for a display device that displays by causing charged particles to migrate by applying an electric field, including a gray level drive step of causing the particles to migrate to a gray level that is not a saturation state in which migration of the particles is saturated. The gray level drive step changes the display by causing the particles to migrate to produce a display color difference.

21 Claims, 33 Drawing Sheets

HOURLY ANIMATION 1/2

DRIVE METHOD FOR A DISPLAY DEVICE, DRIVE DEVICE, DISPLAY DEVICE, AND ELECTRONIC DEVICE

CROSS-REFERENCE TO RELATED APPLICATIONS

Japanese Patent application No. (s) 2007-018424, and 2007-247207, is/are hereby incorporated by reference in its/their entirety.

BACKGROUND

1. Field of Invention

The present invention relates to a particle migration type display device, to a drive method for the display device, to a drive device, to a display device, and to an electronic device.

2. Description of Related Art

Particle migration type display devices such as the electrophoretic display device taught in Japanese Unexamined Patent Appl. Pub. JP-A-2006-267982 are known from literature. Such electrophoretic display devices cause charged particles (including pigment) to migrate by applying an electric field, and the color that is displayed is determined by the color of the particles that are near the viewing surface of the display or the color of the fluid in which the particles are dispersed. Conventionally, this type of particle migration display device is driven by causing the particles to migrate until a saturation state in which particle migration stops is achieved to display content. An electrophoretic display device, for example, requires approximately two seconds to redraw the display to a saturation state once a display redraw command is applied.

A problem with the conventional method of driving a particle migration type display device such as an electrophoretic display device is that the redraw time is relatively long because of this saturation drive method and the display appears to be slow when the display changes. For example, during the initial configuration of a time device having such a display, when setting the time, setting the world time zone, setting a timer, selecting the 12- or 24-hour time display method, or selecting the pattern and thickness of time markers, the display is changed frequently and yet the user must wait for the electrophoretic display to finish redrawing a current display setting before proceeding the next setting.

By comparison, it takes several tens of milliseconds to redraw the display on a liquid crystal display device as taught in Japanese Unexamined Patent Appl. Pub. JP-A-H08-68875, for example, and this fast response speed means that the user can quickly switch between these different settings. This also means that when the time is displayed the second, which must be redisplayed every second, can also be displayed, and the time can be rapidly advanced to adjust the time by holding a button depressed, for example.

However, because particles must be migrated, response times on a typical particle migration type display device are slow, and response times comparable to an LCD panel display cannot be expected since it is not yet possible to rapidly redraw the particle migration display.

SUMMARY OF INVENTION

A display device drive method, display device drive device, display device, and electronic device according to the present invention enable greatly shortening the display redrawing time in a particle migration display device.

A first aspect of the invention is a drive method for a display device that displays by causing charged particles to migrate by applying an electric field, the drive method including a gray level drive step of causing the particles to migrate to a gray level that is not a saturation state in which migration of the particles is saturated. The gray level drive step changes the display by causing the particles to migrate to produce a display color difference.

Another aspect of the invention is a drive device for a display device that displays by causing charged particles to migrate by applying an electric field, the drive device having a gray level drive unit that causes the particles to migrate to a gray level that is not a saturation state by causing the particles to migrate to produce a display color difference.

In this aspect of the invention the display changes based on the difference between displayed gray levels when the display is driven in the gray level drive mode. Changing the display from a color displayed in a saturation state (saturated color) to a gray level color, and changing the display from one gray level to another gray level can be achieved with a shorter field application time than when changing the display from one saturated color to another saturated color, and the change in the display from one gray level to a visibly different gray level can be observed.

Compared with changing the display by means of the saturation drive method of the related art, the time required to change (redraw) the display can be significantly shortened and power consumption can be reduced compared with always driving the display in the saturation drive mode. The effect of driving the display in this way is particularly great when the display content changes frequently, such as when setting the time on a timepiece or initially configuring a device, in which case it is necessary to continuously change the display to set an item selected from a list or a large number of choices.

When the second is displayed or information other than the second that requires changing the display every second is displayed, and when the saturation drive time required to reach the saturation state is longer than one second, the gray level drive method of the invention enables displaying the second or other information that requires changing every second. Because displaying the second is a basic function of a timepiece, the invention is particularly effective when used in a timepiece.

Note that a particle migration type display device as used herein includes charged toner display devices, electronic liquid powder display devices, and electrophoretic display devices.

In another aspect of the invention the drive method for a display device also has a saturation drive step that causes the particles to migrate to a saturation state, and particles in a gray level state are driven to the saturation state by executing the saturation drive step after the gray level drive step.

The drive device for a display device according to another aspect of the invention also has a saturation drive unit that causes the particles to migrate to a saturation state, and the saturation drive unit executes a display redrawing process after the display redrawing process of the gray level drive unit to drive the particles in a gray level state to the saturation state.

The distance the particles migrate changes by controlling the field application time in the gray level drive mode relative to the field application time in the saturation drive mode, and a gray level drive mode and saturation drive mode can be achieved.

The invention changes the display of a gray level achieved by changing the display color in the gray level drive mode to the saturation state by means of the saturation drive mode, and maximizes display reflectivity. This enables changing the display quickly while improving the readability of the display when changing the display ends and the same display state is held.

In the drive method for a display device according to another aspect of the invention at least one of the gray level drive step and the saturation drive step applies a pulse that changes between a first potential and a different second potential to one electrode, and applies either the first potential or second potential to another electrode according the display color.

When driving an electrophoretic display device that causes charged particles disposed between opposing electrodes to migrate between the opposing electrodes, the "one electrode" and the "other electrode" are equal to "one of the opposing electrodes" and the "other of the opposing electrodes."

Further preferably, the drive device for a display device according to the present invention also has a power source; a first potential generating unit that generates from the power source a first potential that is one of two different potentials; a second potential generating unit that generates the second potential of the two potentials from the power source; and a pulse generating unit that generates a pulse that changes between these two potentials.

These aspects of the invention produce an electric field flowing in a specific direction between a first electrode to which a pulse of the first potential is applied and another electrode to which the second potential is applied, and produce an electric field flowing in the opposite direction when the second potential is applied to the first electrode and the first potential is applied to the other electrode. This enables changing the display from one color to another color, and from the other color to the one color, in both directions at the same time on a time-share basis. By thus changing the display in both directions using a time division control method, the display can be driven using a single power source so that the display appears to change simultaneously in both directions.

When a signal (pulse) of the same phase and potential as the pulse applied to the one electrode is applied to the other electrode, a voltage gradient is not produced between the electrodes and the display color remains the same.

The display can be changed simultaneously in both directions by providing two power sources, and applying 0 V to one electrode and applying a positive potential or negative potential to the other electrode according to the display color, but this increases the circuit size because a two channel power supply including booster circuits and other components is required. Using a single power source is therefore particularly beneficial in small devices such as timepieces. Power consumption can also be reduced by not increasing the size of the circuit with booster circuits. The transistors used for potential switching can also be rendered with half the withstand voltage that is conventionally required. The down side of such advantages, however, is that single power source drive increases the time required to redraw the display.

The effect of shortening the time required to change the display is therefore particularly pronounced in the present invention, which has a single power source and requires a long time to change the display.

The drive device for a display device according to another aspect of the invention also has a change display request generating unit that sends a change display request to either the gray level drive unit or the saturation drive unit during one display redrawing process of the saturation drive unit.

When a change display request is asserted, the next display redrawing process starts from the gray level before the saturation state is reached instead of waiting to reach the saturation state, and the time required to change the display can therefore be shortened.

The effect of this is particularly great when display changes start and stop rapidly in succession, such as when an operating button is pressed repeatedly.

One display redrawing process is the process of inputting the drive signal required to rewrite (redraw) the display to the display device. When the display is redrawn repeatedly, plural display redrawing processes occur in succession. Some display devices require plural drive signals for one display redrawing process. The display redrawing process is executed every time a change display request is asserted, such as when an operating button is pressed to change the display or the displayed time is counted down by a timer.

In the drive method for a display device according to another aspect of the invention, the gray level drive step is started by an operation of an operating member that asserts a change display request being held for a prescribed time.

The drive device for a display device according to another aspect of the invention also has an operation detection unit that detects operation of an operating member that asserts a change display request, and the gray level drive unit starts the display redrawing process when the operation detection unit detects operation of the operating member is held for a prescribed time.

This aspect of the invention counts how long an operating member is operated continuously, determines that the users want to select a particular item or set the time, for example, if the operating member is operated continuously for a prescribed time, and therefore starts the gray level drive mode. Driving the display in the gray level drive mode can therefore start appropriately linked to user operations, and the user can watch the setting change.

In the drive method for a display device according to another aspect of the invention, the display redrawing process of the gray level drive step continues if operation of the operating member that asserts a change display request is held during one display redrawing process in the gray level drive step; and control goes from the gray level drive step to the saturation drive step when the operation of the operating member during one display redrawing process in the gray level drive step is released.

The drive device for a display device according to another aspect of the invention also has an operation detection unit that detects operation of an operating member that asserts a change display request. The gray level drive unit executes the display redrawing process when the operation detection unit detects operation of the operating member is held for a prescribed time, and continues the display redrawing process if operation of the operating member is sustained during the one display redrawing process; and the saturation drive unit executes the display redrawing process when operation of the operating member is cancelled during the one display redrawing process of the gray level drive unit.

This aspect of the invention rapidly repeatedly redraws the display in the gray level drive mode while the operation is held, determines that the user has made the selection or completed setting the time when the operation is released (canceled), and changes to the saturation drive mode. The display can thus be driven with a closer link to user operations.

Further preferably, in the drive method for a display device according to another aspect of the invention, the display redrawing process in progress is interrupted and the display redrawing process of the gray level drive step is executed when the operating member that asserts a change display request is operated at a shorter interval from the last time the operating member was operated than the saturation time required for one display redrawing process of the saturation drive step.

The drive device for a display device according to another aspect of the invention also preferably has an operation detection unit that detects operation of an operating member that asserts a change display request, and the gray level drive unit interrupts the display redrawing process in progress and executes the next display redrawing process when the operation detection unit detects operation of the operating member at a shorter interval from the last time the operating member was operated than the saturation time required for one display redrawing process of the saturation drive unit.

When the interval between operations of the operating member is shorter than the saturation time, this aspect of the invention determines that the user wants to consecutively change the display and therefore operates in the gray level drive mode. The display can thus be rapidly redrawn substantially synchronized to the user repeatedly operating the operating member at a short interval (such as rapidly pressing a pushbutton).

The saturation time is the time required to cause the particles to migrate to the saturation state, that is, the time required for one display redrawing process in the saturation drive step.

In the drive method for a display device according to another aspect of the invention, the display redrawing process of the gray level drive step is sequentially executed the number of times the operating member is operated when operation of the operating member that asserts a change display request is repeated at a shorter interval than the saturation time required for one display redrawing process of the saturation drive step.

The drive device for a display device according to another aspect of the invention also has an operation detection unit that detects operation of an operating member that asserts a change display request; and an operation count storage unit that stores the operation count when the operation detection unit detects operation of the operating member at a shorter interval than the saturation time required for one display redrawing process of the saturation drive unit. The gray level drive unit sequentially executes the display redrawing process a number of times based on the operation count stored by the operation count storage unit; and the operation count storage unit resets the stored operation count after the number of display redrawing processes executed by the gray level drive unit based on the operation count.

These aspects of the invention determine that the user wants to consecutively change the display content and enters the gray level drive mode when the operating interval of the operating member is shorter than the saturation time. However, unlike the foregoing aspects of the invention the display redrawing process of the gray level drive mode is not synchronized to operation of the operating member. The display redrawing process of the gray level drive mode is not interrupted by operating the operating member, and repeats the number of times the operating member is operated. More specifically, when more time is required for the gray level drive or saturation drive operation than the operating interval of the operating member, this aspect of the invention reliably changes the display the number of times the button is pressed, for example, while also enabling the user to visually confirm the change in the display state caused by repeatedly pressing the button.

In the drive method for a display device according to another aspect of the invention the gray level drive step starts at a prescribed time or when a prescribed condition is met; and control goes from the gray level drive step to the saturation drive step at a prescribed time or when a prescribed condition is met thereafter.

This aspect of the invention automatically starts the gray level drive process without user intervention and then automatically goes from the gray level drive mode to the saturation drive mode. The above-described effect of shortening the display change can thus also be used at a specific time or when specific conditions are met, such as to announce the time when an alarm is triggered, when counting down a timer, when wiping the display to change the content, or when presenting an animated display at a particular time.

In the drive method for a display device according to another aspect of the invention at least one of the field application time in the gray level drive step and the field application time in the saturation drive step is adjusted according to the temperature when the display is driven.

This aspect of the invention can adapt to the temperature characteristic of particle migration. More specifically, when the particle migration speed drops at temperatures below normal temperature, a longer field application time can be used when the temperature is low than at normal temperature to achieve the same reflectivity as at normal temperature, and the display can be driven to change quickly and crisply.

The drive method and drive device of the invention can be used in various kinds of particle migration display devices, including electrophoretic display devices, charged toner display devices, and electronic liquid powder display devices.

An example of a charged toner display device has charged toner and microparticles sealed between a pair of substrates that are coated with a charged carrier material.

An example of an electronic liquid powder display device has an electronic liquid powder that has properties between a liquid and a powder sealed between substrates, and uses two types of electronic liquid powders that have different colors and are mutually repulsive when charged to display content.

A display device according to another aspect of the invention is driven by the drive device or by the drive method for a display device according to the present invention.

This aspect of the invention achieves the same effect as the foregoing aspects of the invention because it is driven by the same drive method or drive device described herein.

Preferably, the display device of the invention is an electrophoretic display device.

An electrophoretic display device has greater reflectivity than other types of display devices, and can display a wide range of gray levels. More particularly, electrophoretic display devices can be easily read using the difference between a color of one gray level and a color of another gray level, and is therefore a good application of the invention.

Because an electrophoretic display device offers fast initial response when a field is applied, a color density that is sufficient to express display changes (response, reaction) can be achieved in a short time after applying the field starts. This characteristic also makes electrophoretic display devices a good application of the invention.

Electrophoretic display devices include two-particle systems that two oppositely charged particles of different colors, and single particle systems that have a single particle and display two colors using the particle and the color of the fluid medium. The display color of an electrophoretic display device is also not limited to two colors, and a color display can be achieved using RGB particles.

Display methods corresponding to the particle migration direction of the electrophoretic display device include vertical migration drive methods that cause the particles to migrate between front and back substrates as seen in the viewing direction, and horizontal migration drive methods that cause particles to migrate to the sides of side walls dividing pixels or to a flat part of the pixels.

Electrophoretic display device drive methods also include segment drive and dot matrix drive.

An electronic device according to another aspect of the invention has the drive device for a display device according to the invention.

This aspect of the invention achieves the same effect as the foregoing aspects of the invention because it is driven by the drive device of the invention.

An electronic device according to another aspect of the invention has a timekeeping unit and a time information display unit that displays time information kept by the timekeeping unit.

An electronic device according to this aspect of the invention is rendered as a timepiece or having a timekeeping function.

Because the display can be changed in a short time as described above, this aspect of the invention enables the timepiece to also display the second, which is a basic function of any timepiece. More specifically, by using the invention in a timepiece, the effect of changing the display in a short time can be used to good purpose.

In addition, in a timepiece that has an alarm, a world time function, a timer, or other timekeeping functions, the different functions can be selected and the settings can be changed quickly.

The invention enables greatly shortening the display redrawing time in a particle migration display device.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 1:
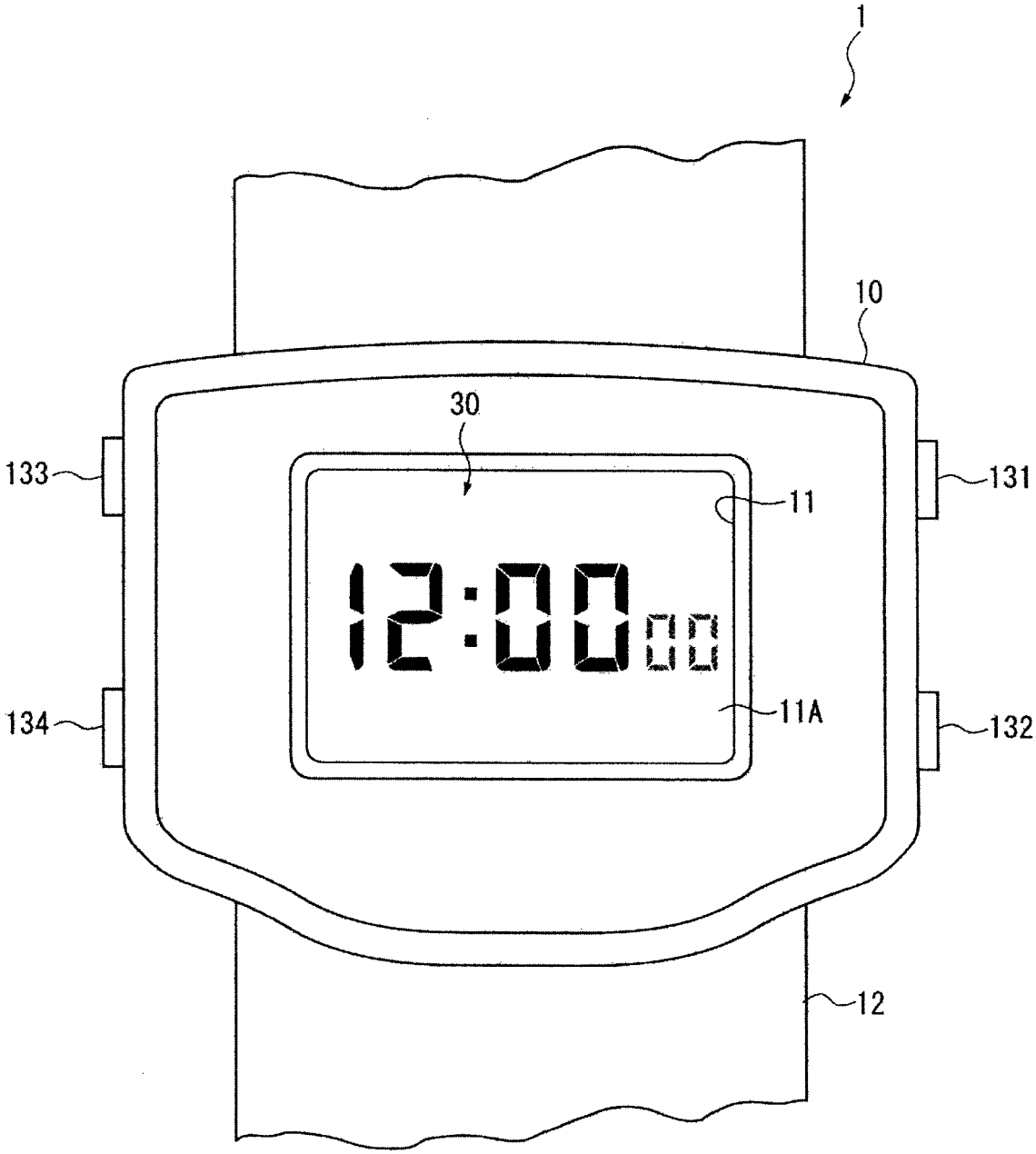
FIG. 1 is an external view of a timepiece according to a first embodiment of the invention.

Preferred embodiments of the present invention are described below with reference to the accompanying figures.

Note that like parts are identified by the same reference numerals in the following embodiments and further detailed description of like parts is omitted or simplified in the second and later embodiments.

Embodiment 1

A first embodiment of the invention is described below with reference to the accompanying figures.

General Configuration

FIG. 1 is a plan view showing the appearance of a timepiece 1 as an electronic device according to the first embodiment of the invention.

The timepiece 1 is a digital wristwatch that has a case 10 with a rectangular window 11 formed in the face, a band 12, and an electrophoretic display panel 30 that is visible through window 11. A crystal 11A covers the window 11, and operating buttons 131 to 134 are disposed on the side of the case 10.

Electrophoretic Display Panel Module

Figure 2:
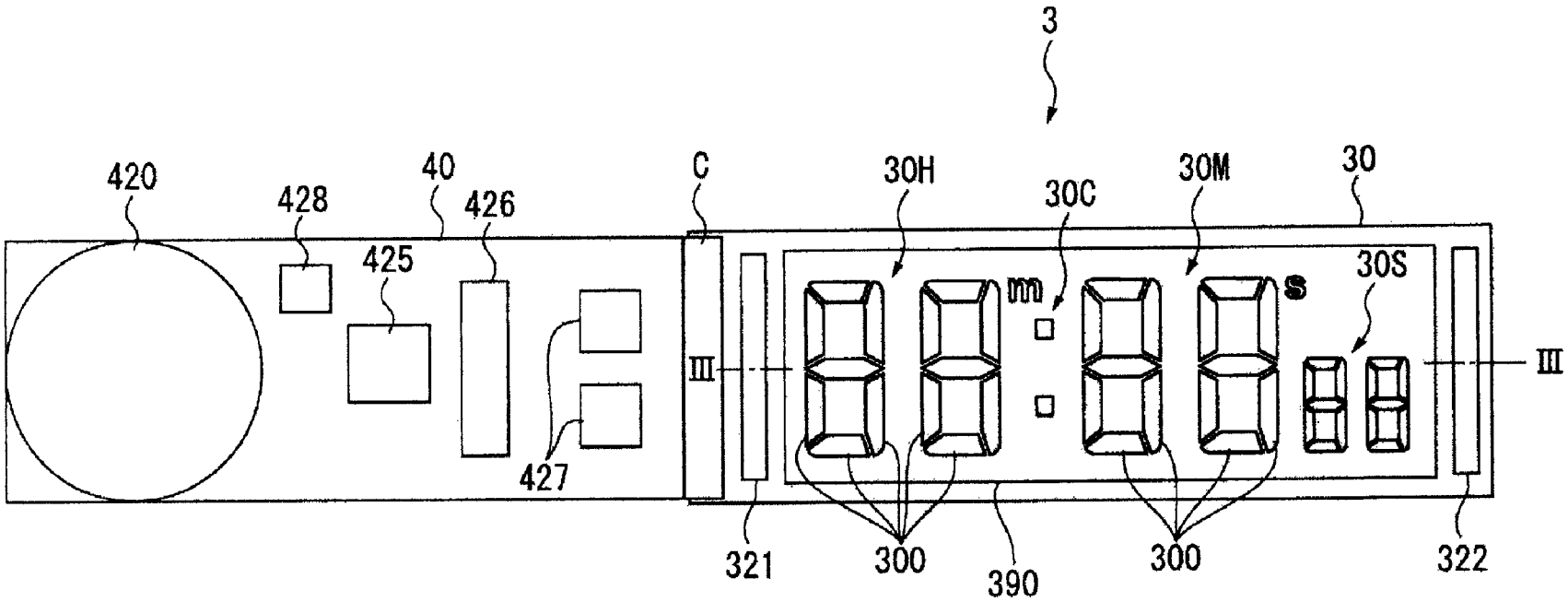
FIG. 2 is a plan view of the display module in the first embodiment of the invention.

FIG. 2 is a plan view schematically showing the arrangement of an electrophoretic display panel module 3. The electrophoretic display panel module 3 has electrophoretic display panel 30 and a drive control circuit board 40 which are connected to each other by an anistropic conductive film (ACF). When housed inside the case 10, the electrophoretic display panel 30 and the drive control circuit board 40 are folded together at a wiring member C.

2-1 Control Circuit Board

Mounted on the drive control circuit board 40 are a power supply 420 that is the power source of the timepiece 1, a controller 425 that controls the timepiece 1, a driver IC 426 for the electrophoretic display panel 30, a switching device 427, and a crystal oscillation circuit 428. The power supply 420 is preferably a primary battery in this embodiment of the invention, but could be a secondary battery or other type of power source.

Though not shown in detail, the driver IC 426 and the wiring member C are connected to each other.

2-2 Electrophoretic Display Panel

An hour display unit 30H, a minute display unit 30M, and a second display unit 30S that use seven-segment display units to display numbers are disposed on the display panel 30. A two-segment colon (:) display unit 30C is disposed between the hour display unit 30H and the minute display unit 30M. An "m" and an "s" segment that are displayed when the chronograph function is operating are also provided. Unless it is necessary to refer to a particular segment, these display units are collectively referred to below as segment 300.

A background display electrode 390 that is used to display a background in all parts of the display area other than the segments 300 is also disposed to the display panel 30.

Figure 3:
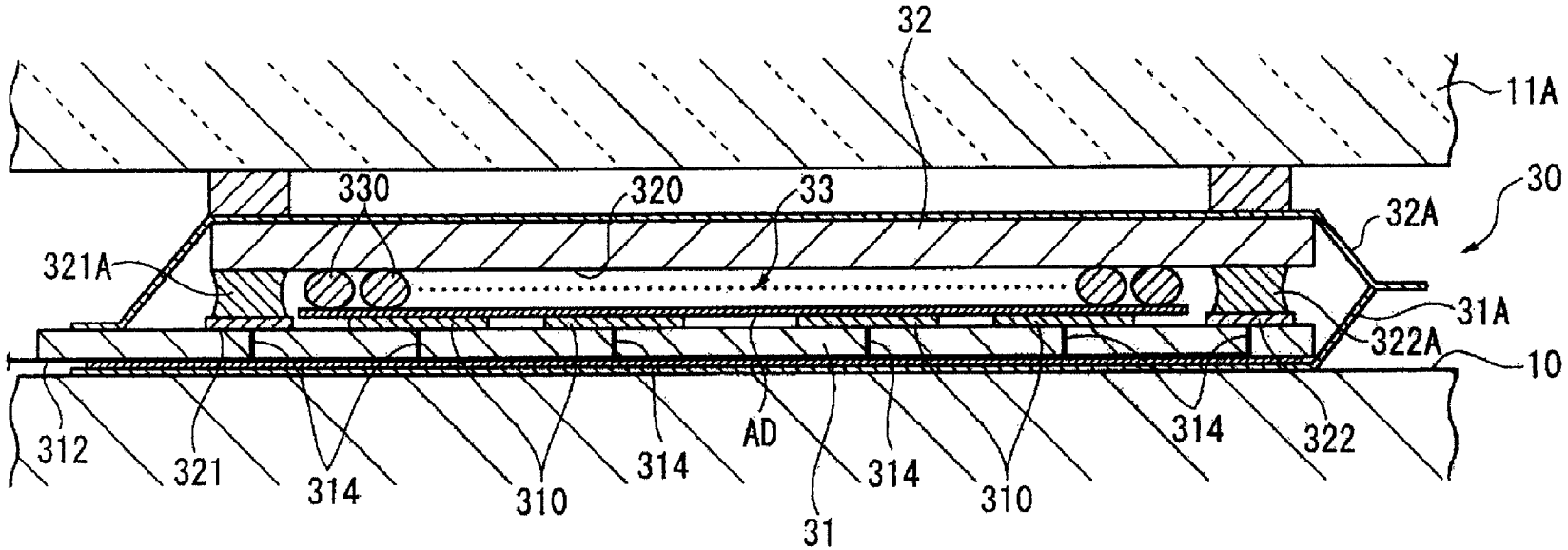
FIG. 3 is a section view along line III-III of FIG. 2.

FIG. 3 is a section view of the display panel 30 through line III-III in FIG. 2.

The display panel 30 is a flat, rectangular panel disposed inside the case 10, and includes a display substrate 31, a transparent substrate 32, and an electrophoretic layer 33 disposed between the display substrate 31 and the transparent substrate 32.

A segment electrode 310 corresponding to each of the segments 300 is disposed to the surface of the display substrate 31 (the surface opposite the transparent substrate 32), and electrodes 321, 322 that are conductive to electrodes on the transparent substrate 32 side are disposed to the lengthwise edge parts of the display substrate 31.

A plurality of microcapsules 330 are bonded by applying an adhesive (adhesive layer) AD to the surface of the segment electrode 310, and these microcapsules 330 form the electrophoretic layer 33.

Wiring 312 formed on the back side of the display substrate 31 connects the segment electrode 310, the background display electrode 390, and the electrodes 321, 322 formed on the front of the display substrate 31 to the control circuit board 40 through the intervening wiring member C (FIG. 2). The wiring 312 is connected to the electrodes by means of vias 314 passing through the thickness of the display substrate 31.

A transparent common electrode 320 made of ITO (indium tin oxide), for example, is disposed to the back side of the transparent substrate 32 (the surface facing the display substrate 31). This common electrode 320 covers substantially the entire back side of the transparent substrate 32, and is the electrode common to each of the segment electrodes 310 for applying a voltage to each of the segment electrodes 310. A conductive member 321A, 322A is disposed between the common electrode 320 and the electrodes 321, 322, respectively.

The transparent substrate 32, the microcapsules 330, and the display substrate 31 are sealed by a moisture resistant sheet 32A disposed to the front surface of the transparent substrate 32 and a moisture resistant sheet 31A disposed to the back side of the display substrate 31.

Displaying by Means of Electrophoresis

Figure 4:
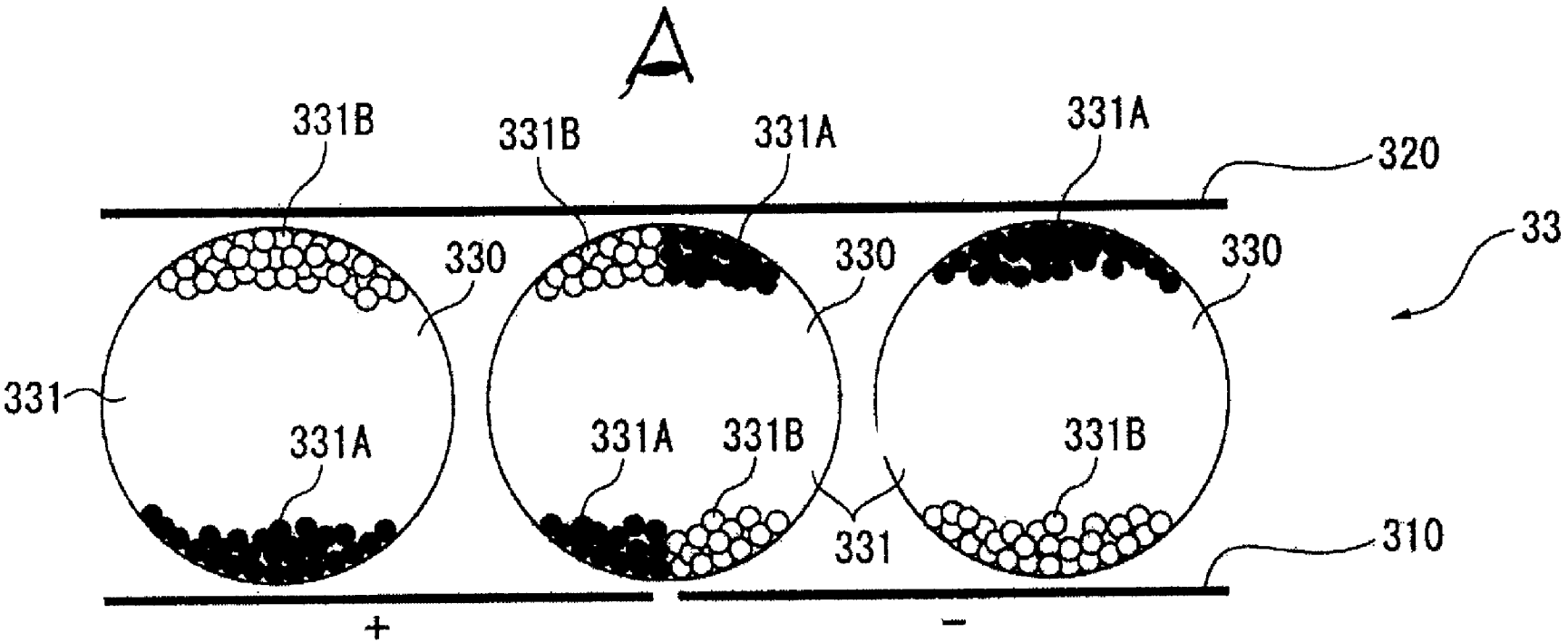
FIG. 4 is a schematic diagram of an electrophoretic layer in the display panel of the first embodiment of the invention.

FIG. 4 is a schematic diagram showing the electrophoretic layer 33 of the display panel 30. The electrophoretic layer 33 is formed by a high density array of numerous microcapsules 330, each microcapsule 330 containing an electrophoretic dispersion 331 of numerous suspended charged particles. The electrophoretic dispersion 331 renders an electrophoretic layer containing fluid particles of two different colors, specifically black electrophoretic particles ("black particles" below) 331A and white electrophoretic particles ("white particles" below) 331B. The black particles 331A and the white particles 331B are oppositely charged pigment, and in this embodiment of the invention the black particles 331A are negatively charged and the white particles 331B are positively charged.

More specifically, when the segment electrode 310 is driven to a high potential level (HIGH) and the common electrode 320 is driven to a low potential level (LOW), the potential difference produces a field flowing from the common electrode 320 to the segment electrode 310, and causes the negatively charged black particles 331A to migrate toward the segment electrode 310 and the positively charged white particles 331B to migrate toward the common electrode 320. When the white particles 331B reach a saturation state near the maximum concentration at the common electrode 320, the display therefore is white.

When the display is reversed from this white display so that the segment electrode 310 goes LOW and the common electrode 320 goes HIGH, the field reverses and the display panel 30 changes to black when the black particles 331A reach a saturation state near the maximum concentration at the common electrode 320. In the example shown in FIG. 1 the segments rendering the numbers and colon of the "12:00" are displayed black.

Grays between black and white can also be displayed by adjusting the applied voltage and how long the voltage is applied to control how far the black particles 331A and the white particles 331B migrate.

To hold the same display color, the electric field is stopped. When the field is stopped the positions of the black particles 331A and the white particles 331B ideally does not change, the black particles 331A and white particles 331B stay in the same position, and the displayed color is retained.

Drive Control Unit

Figure 5:
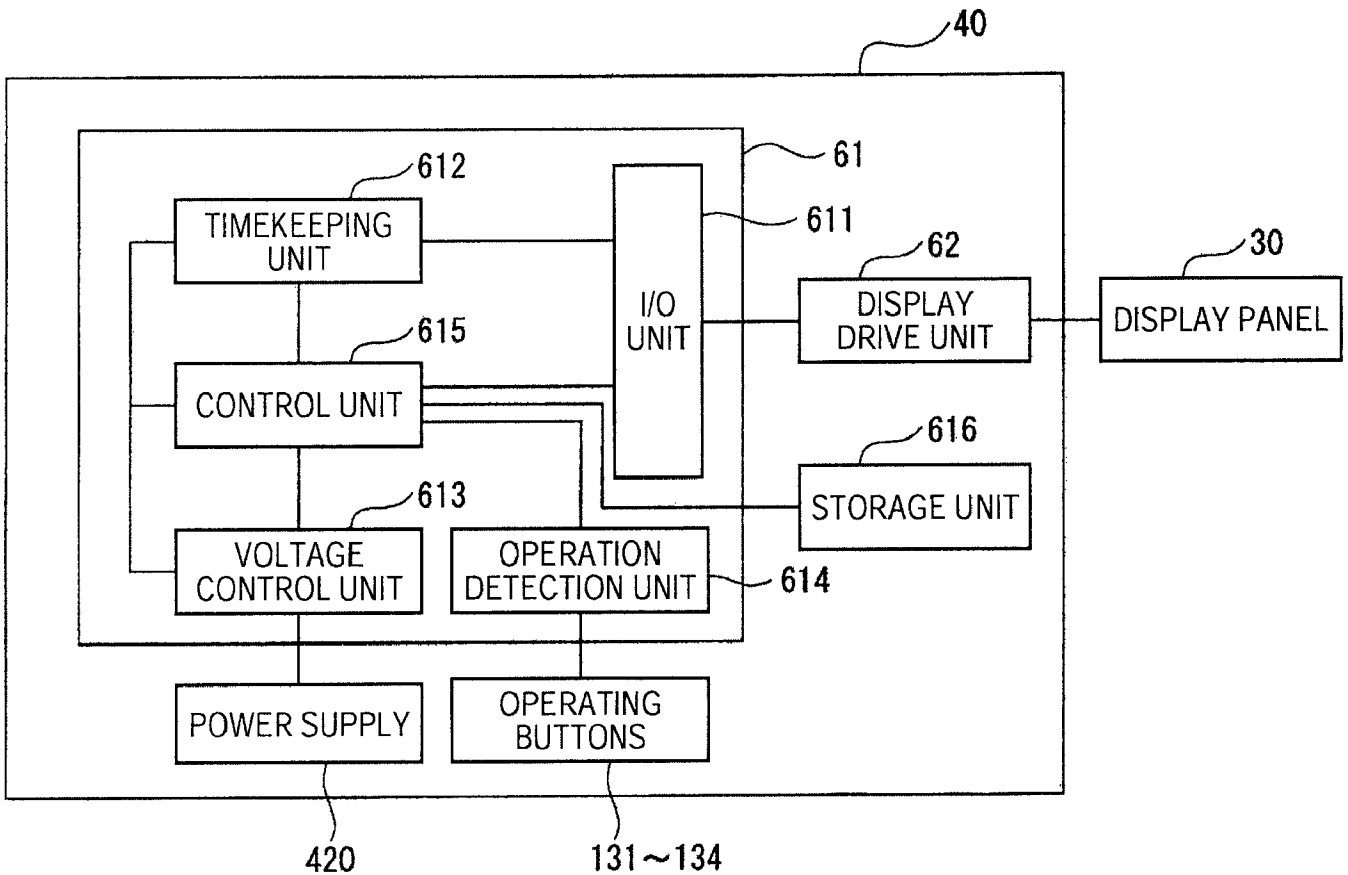
FIG. 5 is a block diagram showing an electrical arrangement of a control circuit board in the first embodiment of the invention.

FIG. 5 is a block diagram showing the electrical arrangement of the drive control circuit board 40 (FIG. 2). The drive control circuit board 40 includes a drive control unit 61 mounted on the controller 425 and a display drive unit 62 mounted on the driver IC 426 (FIG. 2), and functions as the drive device of the display panel 30.

The drive control unit 61 has an I/O unit 611 that handles display drive unit 62 input and output, a timekeeping unit 612 that keeps the time, a voltage control unit 613 for supplying power from the power supply 420 to the other circuit components 425 to 428, a control unit 615 that control the operation of other parts 611 to 614, and a storage unit 616.

The timekeeping unit 612 keeps time by counting oscillation pulses output by crystal oscillation circuit 428 (FIG. 2), and the timekeeping unit 612 controls the I/O unit 611 through the control unit 615.

The display drive unit 62 applies a drive signal to the display panel 30 (i.e. applies a voltage across the common electrode 320 and the segment electrodes 310 (FIG. 3) of the display panel 30). Based on the time information acquired from the timekeeping unit 612, the display drive unit 62 applies a drive signal of a prescribed potential to each of the segment electrodes 310.

Display Drive Unit

Figure 6:
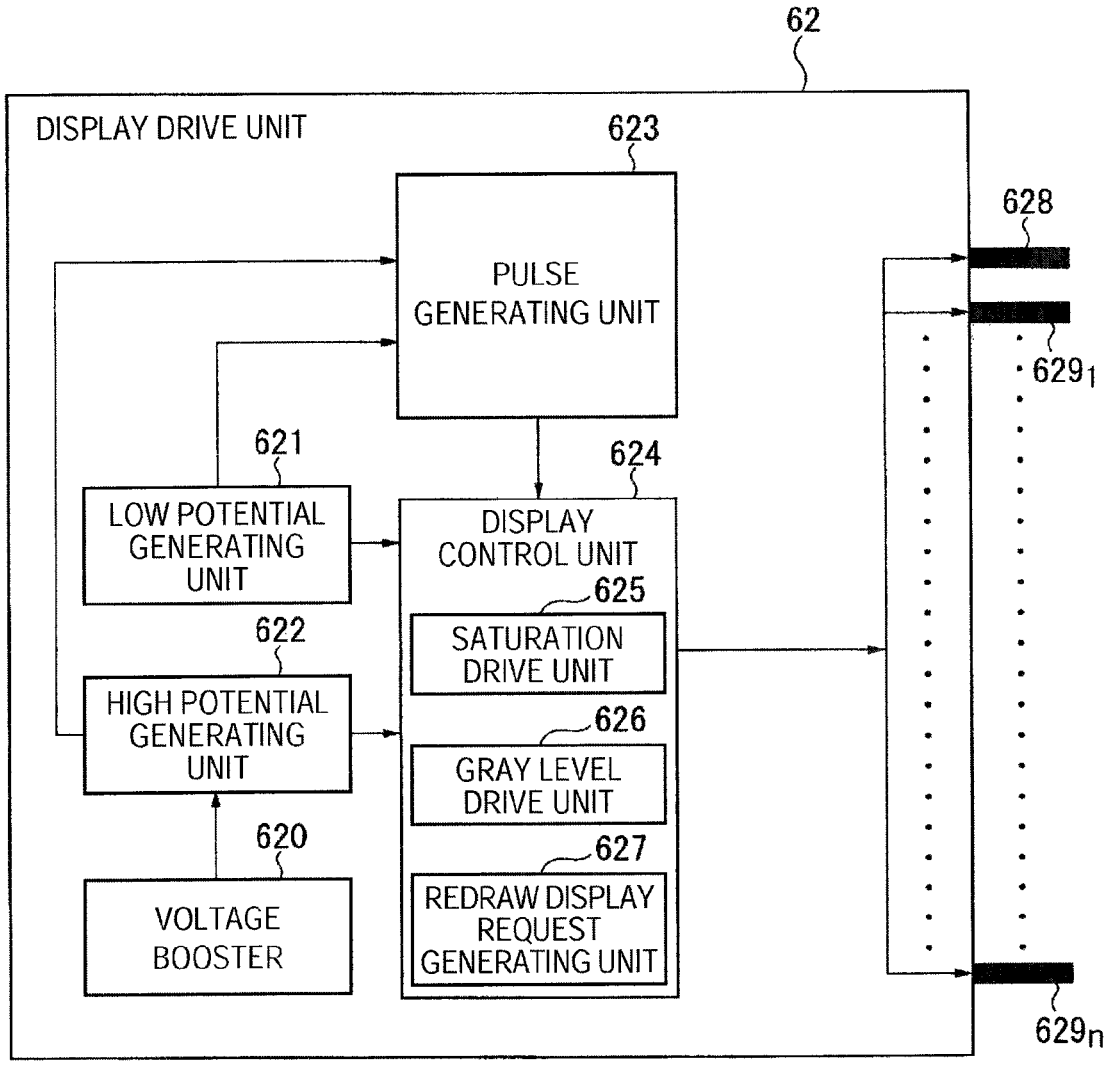
FIG. 6 is a block diagram of a display drive unit in the first embodiment of the invention.

FIG. 6 is a block diagram showing the arrangement of the display drive unit 62 that drives the display panel 30. The display drive unit 62 has a voltage booster 620, a LOW potential generating unit 621, a HIGH potential generating unit 622, a pulse generating unit 623, and a display control unit 624.

The LOW potential generating unit 621 generates a LOW potential (first potential, 0 V in this embodiment of the invention). The 622 is connected to the voltage booster 620 and generates a HIGH potential (second potential, +15 V in this embodiment of the invention). The pulse generating unit 623 generates pulses having a voltage potential similar to the potential generated by the potential generating units 621 and 622. The display control unit 624 changes the potential output to the display panel 30 according to the display state, and controls the drive time (how long the electric field is applied).

The voltage booster 620 boosts the voltage supplied from the power supply 420 (such as 1.5 V) to the high potential (15 V in this embodiment of the invention).

The display drive unit 62 has a common electrode pin 628 that is connected to the common electrode 320, and a plurality of segment electrode pins $629_1$ to $629_n$ corresponding to each of the segments 300 as the plural output pins of the driver IC 426, and output to these pins is controlled by the display control unit 624.

The display control unit 624 has a saturation drive unit 625 that drives the particles 331A and 331B of the display panel 30 to the saturation state, a gray level drive unit 626 that drives the particles 331A and 331B to a gray level that is a state other than the saturation state, and a redraw display request generating unit 627 that generates a change display request.

5. Display Panel Drive Process

Driving the display panel 30 is described next.

5-1 Saturation Drive

Figure 7:
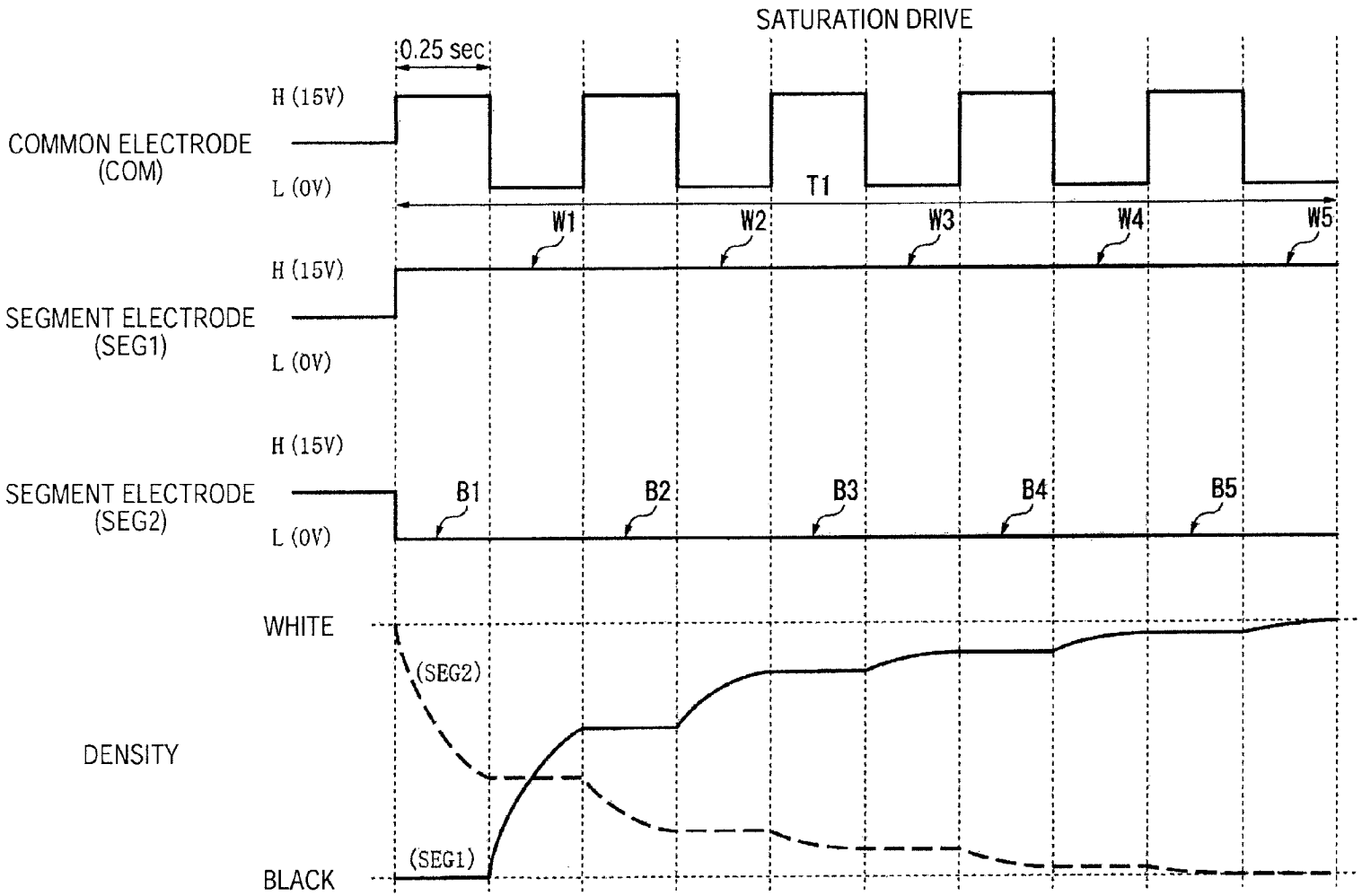
FIG. 7 shows an example of a drive signal (saturation drive process) applied to the display panel of the first embodiment of the invention.

FIG. 7 shows part of the saturation drive process of the saturation drive unit 625. In FIG. 7 COM denotes the potential of the drive pulse that is output from the display drive unit 62 to the common electrode (COM) and changes between LOW and HIGH, and SEG1 and SEG2 denote the potentials of the drive signals that are output from the display drive unit 62 according to the display color and applied to the segment electrodes 310 (FIG. 3).

The density of the display color on the display panel 30 is shown in the graph at the bottom of FIG. 7.

In the saturation drive process the display is redrawn once in ten half-wavelengths (five pulses, five cycles, or five cycles periods) of the COM signal as shown in FIG. 7. In this embodiment of the invention the half-wavelength of the COM signal is 0.25 ms. Drive period T1, which is one set of ten half-wavelengths of the COM signal is the prescribed time (saturation time) of one redraw operation.

When SEG1 is HIGH and COM is LOW (W1 to W5), voltage is applied between SEG1 and COM. This causes the white particles 331B to migrate to the display side of the display panel 30, the black particles 331A to migrate to the back of the display panel 30 and go to the saturation state, and the display color to change from black to white as the color density changes as indicated by the solid line in FIG. 7.

When SEG2 is low and COM is high (B1 to B5), voltage is applied between SEG2 and COM. This causes the black particles 331A to migrate to the display side of the display panel 30, the white particles 331B to migrate to the back of the display panel 30 and go to the saturation state, and the display color to change from white to black.

Though not shown in FIG. 7, a pulse signal of the same phase and potential as COM is applied to the segment electrodes 310 (FIG. 3) of any segments that are held to the same display color. Voltage is thus not applied to the corresponding segment and the display color remains the same black or white. SEG1 and SEG2 are also the same pulse signal as COM when the display color of the segment to which SEG1 or SEG2 is applied remains the same.

In the normal time display mode, this embodiment of the invention drives the hour display unit 30H and the minute display unit 30M by the saturation drive process shown in FIG. 7. As shown in FIG. 1, the seconds may also be displayed on display panel 30 in this embodiment of the invention, but at other times the hours and minutes of the time are displayed in the saturation drive mode and the segments 300 of the hour display unit 30H and minute display unit 30M are driven to display black or white depending upon the number displayed.

5-2 Gray Level Drive Process

Figure 8:
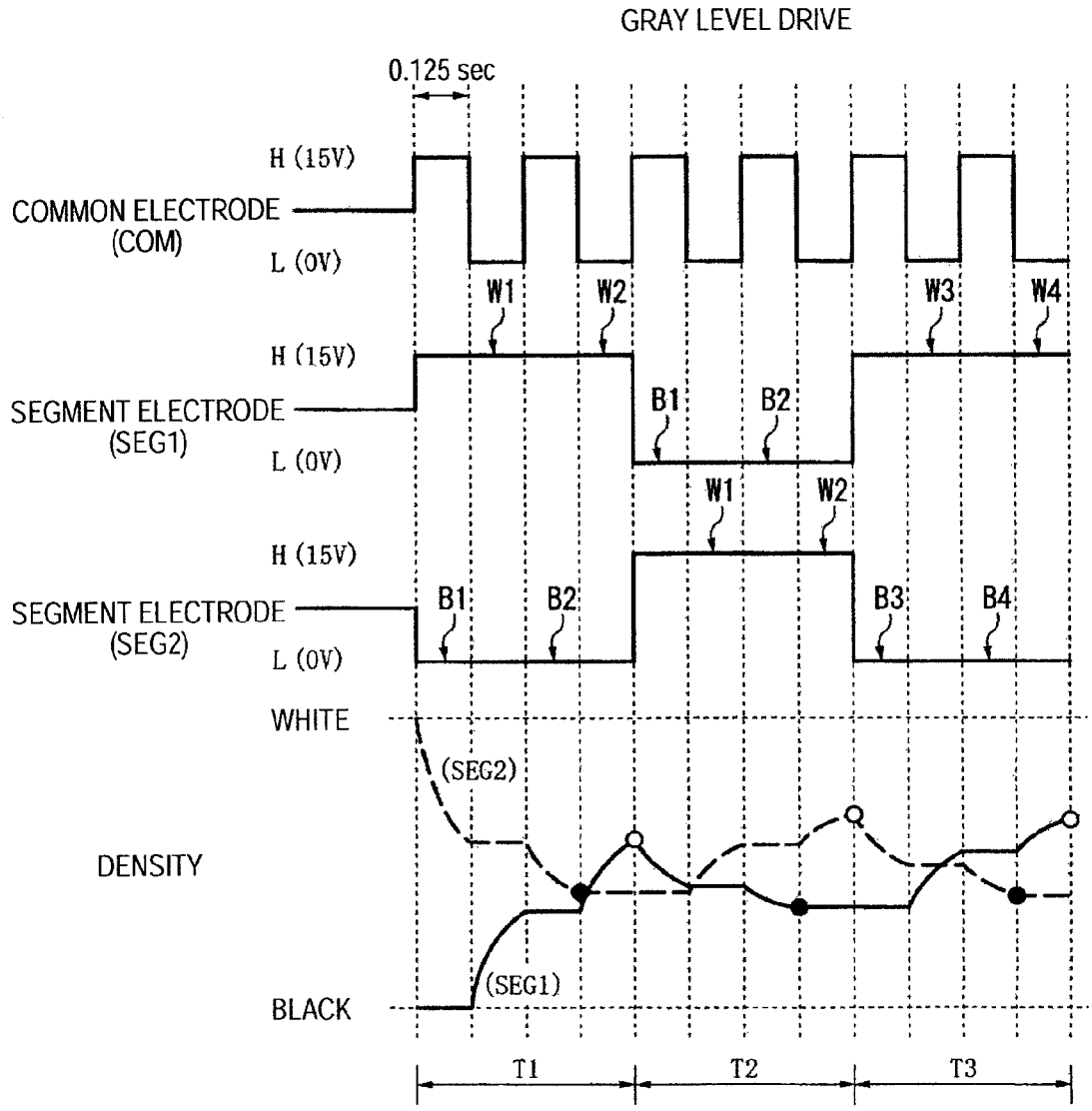
FIG. 8 shows an example of the drive signal (gray level drive process) applied to the display panel of the first embodiment of the invention.

FIG. 8 describes the gray level drive process of the gray level drive unit 626 (FIG. 6). In the gray level drive process the drive time (electric field (or voltage) application time) of one redraw operation is shorter than in the saturation drive mode shown in FIG. 7. More specifically, the half-wavelength of the COM signal in the gray level drive mode is half the half-wavelength of the COM signal in the saturation drive mode, that is, 0.125 s. The drive period is one set of four half-wavelengths of the COM signal (two pulses or cycles or periods spanning 0.5 s), which is the prescribed time of one redraw period in the gray level drive mode.

The COM signal wavelength described here is used for example only, and the half-wavelength of the COM signal in the gray level drive mode can be set from greater than or equal to approximately 0.005 s (5 ms) in units of approximately 0.005 s (5 ms). At normal room temperature, the half-wavelength of the gray level drive mode can be set from approximately 0 s to less than or equal to approximately 0.6 s in this embodiment of the invention. As an example in which the half-wavelength is 0 s, one half-wavelength of the full wavelength is 0 s and the other is 0.05 s, for example. This method is useful for shortening the redraw time when drawing the entire display panel 30 to white (or light gray) or black (or dark gray). More specifically, the display is not switched on a time-share basis between driving the display to white (or light gray) and driving the display to black (or dark gray), and the display is driven in one direction only. In other words, the display can switch as needed between the operation writing the display in both directions on a time-share basis by means of the COM pulse as shown in FIG. 8, and the operation writing the display in only one direction instead of both directions on a time-share basis.

This embodiment of the invention adjusts the field application time of the gray level drive mode and the saturation drive mode according to the current temperature. When the contrast achieved by migration of the particles 331A and 331B for the same amount of time is compared, the resulting contrast is lower when the temperature is low than when the temperature is at room temperature, for example. The number of COM pulses applied in one drive period (such as T1) or the half-wavelength is therefore increased to achieve the same contrast. Thus increasing the nominal field application time (drive time) achieves the same reflectivity as at normal temperature. The field application time in the saturation drive mode of the embodiment shown in FIG. 7 is 2.5 seconds at normal temperature and twice that or 5 seconds at 0° C.

This embodiment of the invention enables setting the number of COM pulses in one drive period (such as T1) from 1 to 6000 in order to achieve a visible difference in gray level and acceptable response to user operations when the operating conditions, such as the ambient temperature, change.

The nominal field application time is set appropriately according to the applied voltage, particle diameter, and other conditions.

In the example shown in FIG. 8 SEG1 denotes the potential when the display color changes continuously from black to white (COM is LOW and SEG1 is HIGH, i.e. W1 and W2), from white to black (COM is HIGH and SEG1 is LOW, i.e. B1 and B2), and then back from black to white again (W3 and W4). When COM is HIGH and SEG1 is LOW, the display goes to black (B1, B2). The density of the display color of the segment to which SEG1 is applied is indicated by the solid line in the graph at the bottom of FIG. 8.

SEG2 denotes the potential when the display color changes continuously from white to black (COM is HIGH, SEG2 is LOW, i.e. B1 and B2), from black to white (COM is LOW and SEG2 is HIGH, i.e. W1 and W2), and then from white to back again (B3 and B4). When COM is LOW and SEG2 is HIGH, the display goes to white (W1, W2). The density of the display color of the segment to which SEG2 is thus applied is indicated by the dotted line in the graph.

In this case the display color of the segments to which SEG1 and SEG2 are applied in one redraw period does not go to the saturation state (black or white) and stops at a gray level so that the segment is gray. The display content can be changed (redrawn), however, based on the difference in the display color (density difference) of the SEG1 segment and the SEG2 segment.

More specifically, the display color produced by SEG1 at the end of white drawing period W2 in drive period T1 in FIG. 8 is a light gray that is closer to white than black as denoted by the white dot (O), and the display color produced by SEG2 at the end of black drawing period B2 is a dark gray that is closer to black than white as denoted by the black dot (•). This light gray and black gray are visibly different, and the display can be redrawn based on the difference in these colors.

Similarly to drive period T1, the display can be redrawn based on the difference in the dark gray indicated by the black dot (•) at the end of the black drawing period B2 of the SEG1 segment, and the light gray indicated by the white dot (O) at the end of the white drawing period W2 of the SEG2 segment in drive period T2.

In drive period T3, the display color produced by SEG1 at the end of white drawing period W4 denoted by the white dot (O) is light gray, the display color produced by SEG2 at the end of black drawing period B4 denoted by the black dot (•) is dark gray, and the display can be redrawn based on the difference in these colors.

The saturation drive mode and gray level drive mode are selected as needed as further described below. If a new change display request is asserted while driving the display to the saturation state in the saturation drive mode, the redraw display request generating unit 627 (FIG. 6) sends a control signal to the saturation drive unit 625 (FIG. 6) to execute the next display process.

More specifically, if a change display request is asserted in the saturation drive mode shown in FIG. 7, the display process is interrupted and the new (next) display process can continue in the saturation drive mode.

6. Driving the Display Panel

Driving the display panel 30 when different functions of the timepiece 1 are used is described next.

6-1 Setting the Time

Figure 11A:
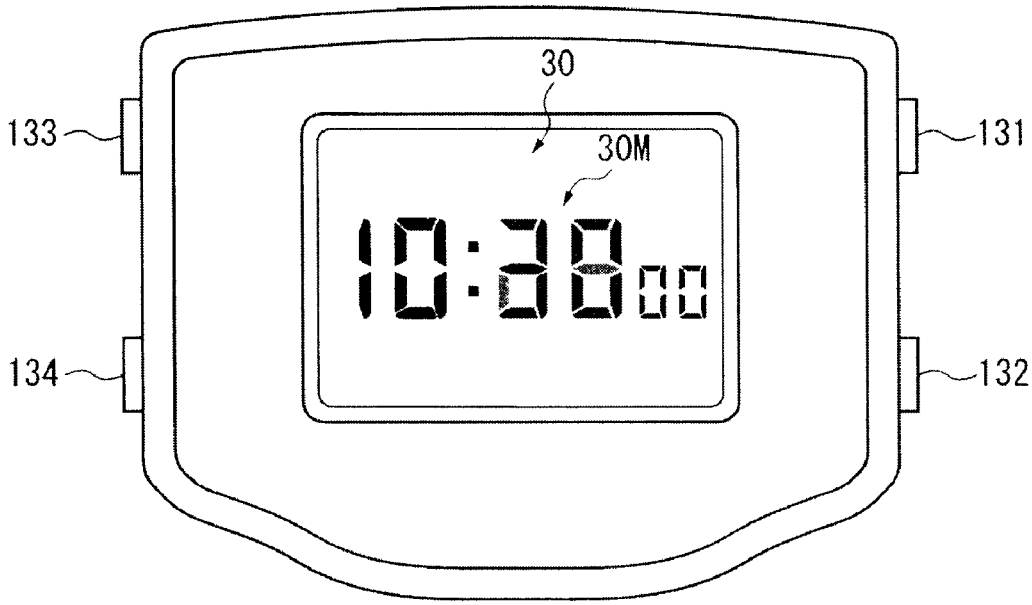
FIGS. 11A and 11B show the display in a time adjustment mode.
Figure 11B:
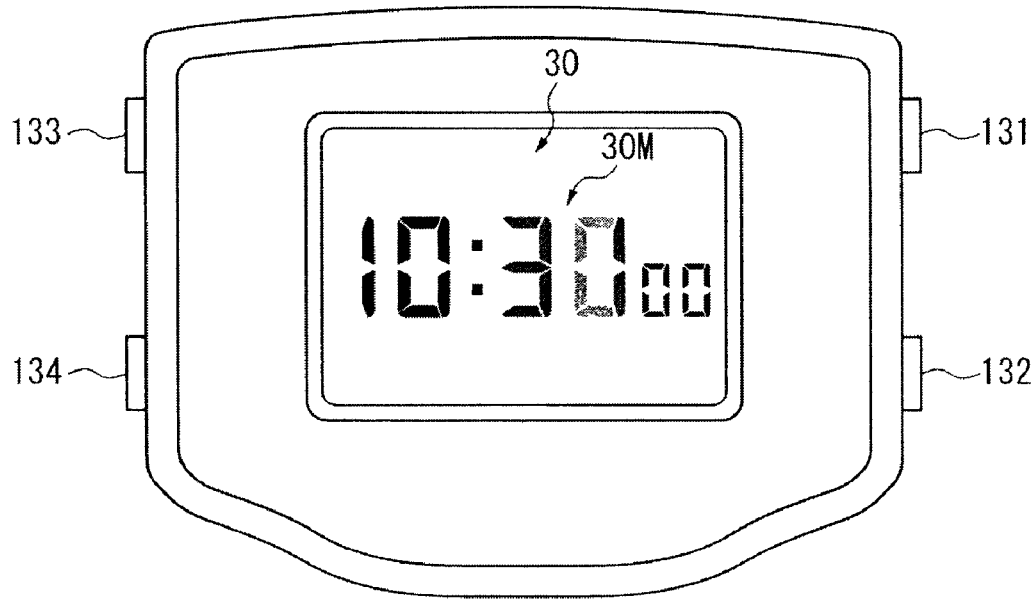
Figure 12A:
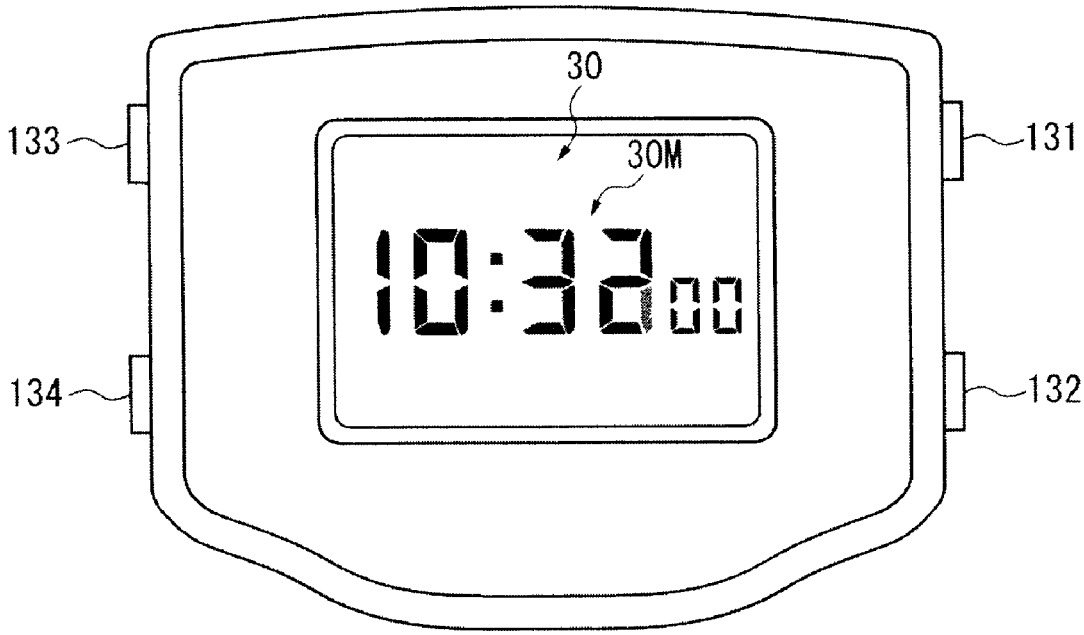
FIGS. 12A and 12B show the display in a time adjustment mode.
Figure 12B:
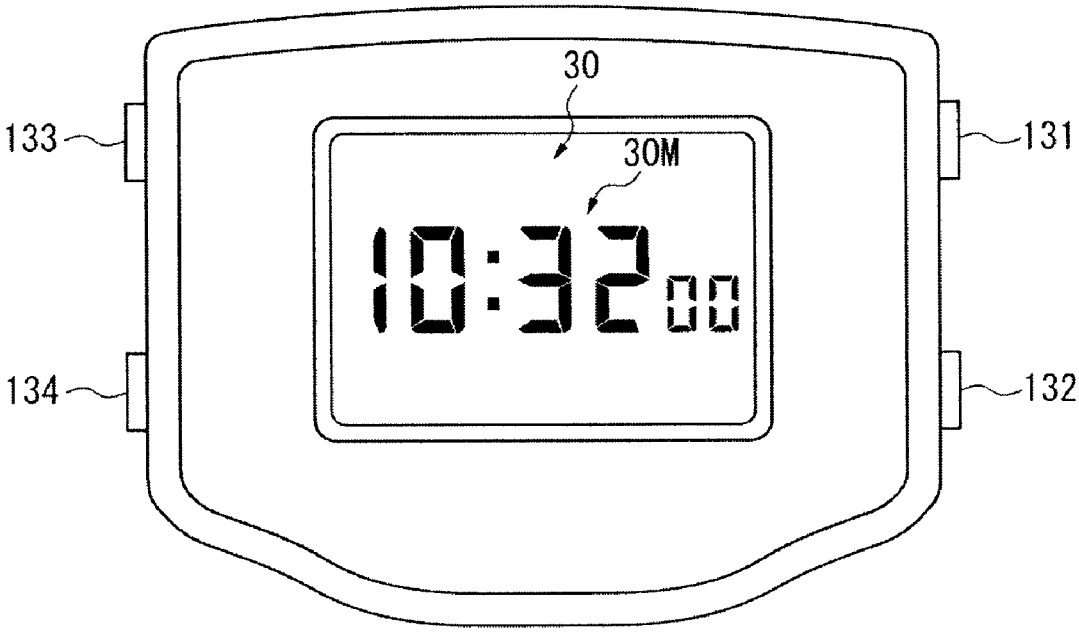
Figure 13:
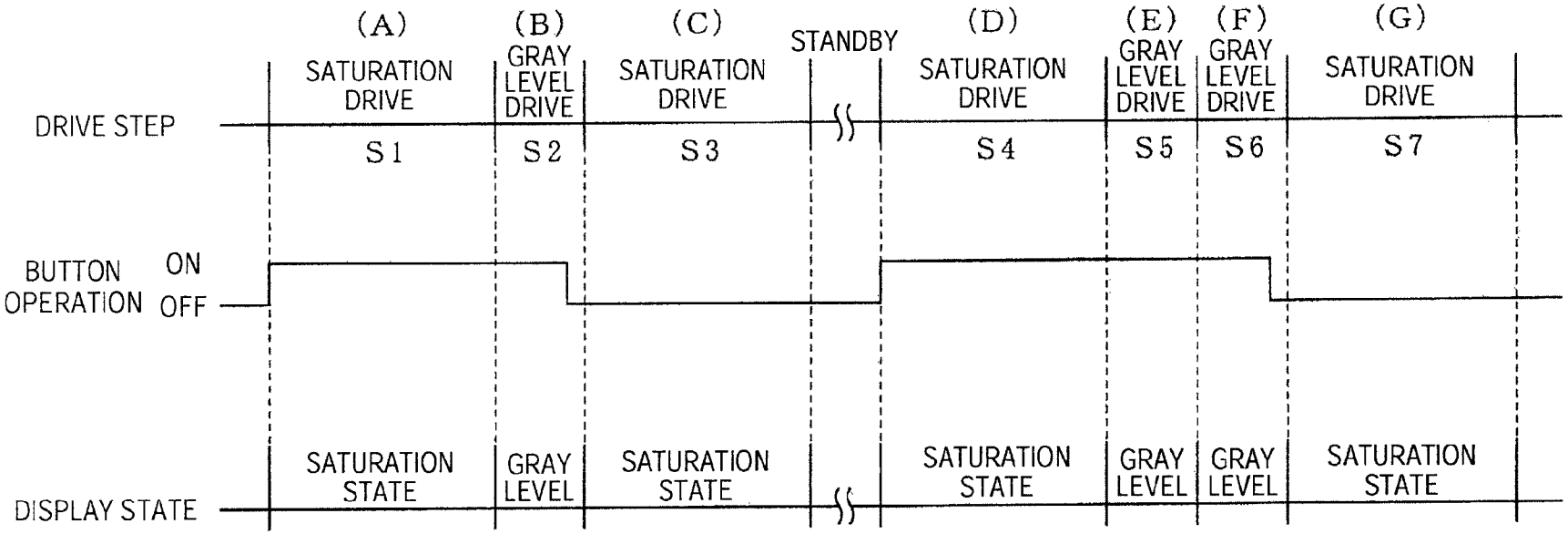
FIG. 13 shows changes in the drive process in the time setting mode when an operating button is pressed and held.
Figure 14:
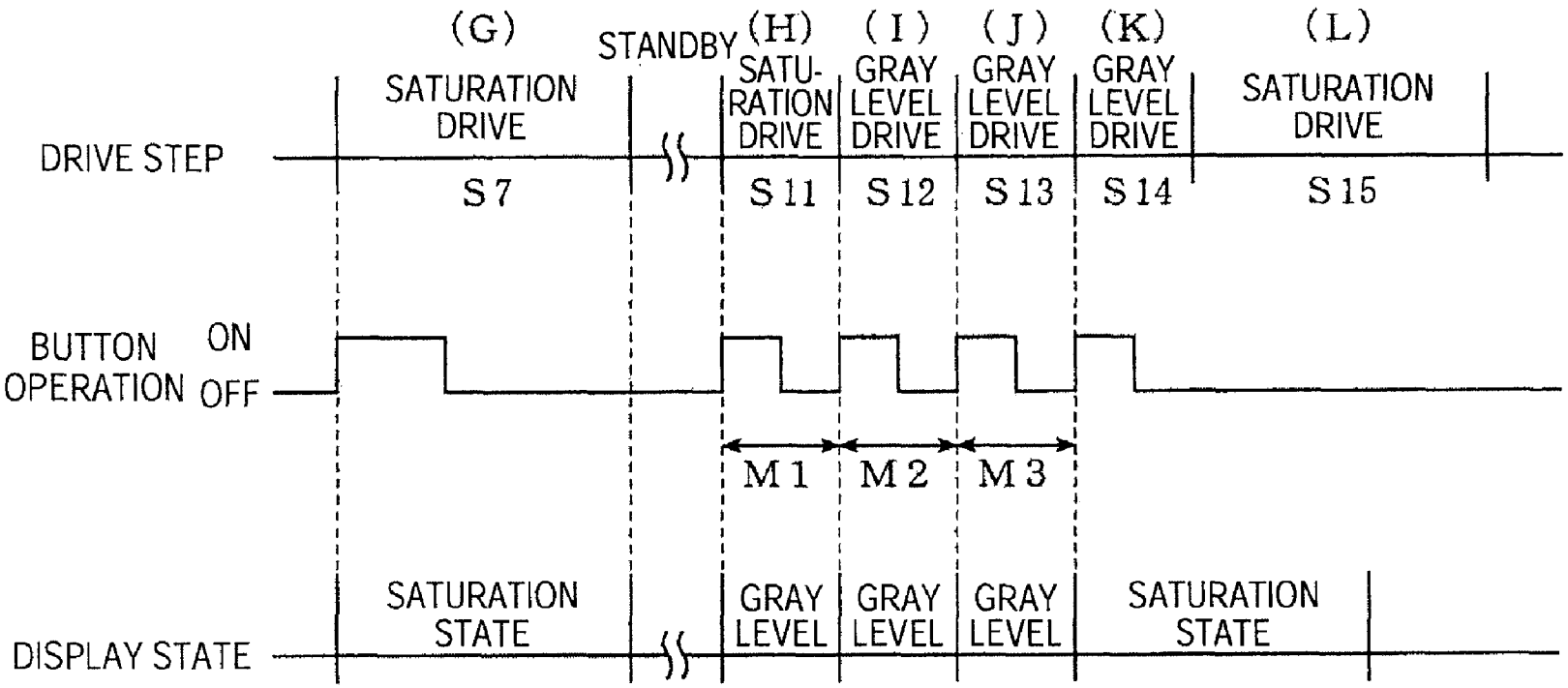
FIG. 14 shows changes in the drive process in the time setting mode when the operating button is pressed repeatedly.

FIGS. 9A to FIG. 12B show the time display when setting the time, and FIG. 13 and FIG. 14 describe the changes in the drive process during the operation shown in FIGS. 9A to FIG. 12B.

FIG. 13 and FIG. 14 show the drive sequence (top row in the figures), the operating sequence of an operating button 131 (middle row), and the display state of the display panel 30 (bottom row).

Each of the saturation drive steps shown in FIG. 13 and FIG. 14 mean the display redrawing process in one saturation period T1 shown in FIG. 7. Each gray level drive step shown in FIG. 13 and FIG. 14 mean one display redrawing process in T1 in FIG. 8, for example.

Figure 9A:
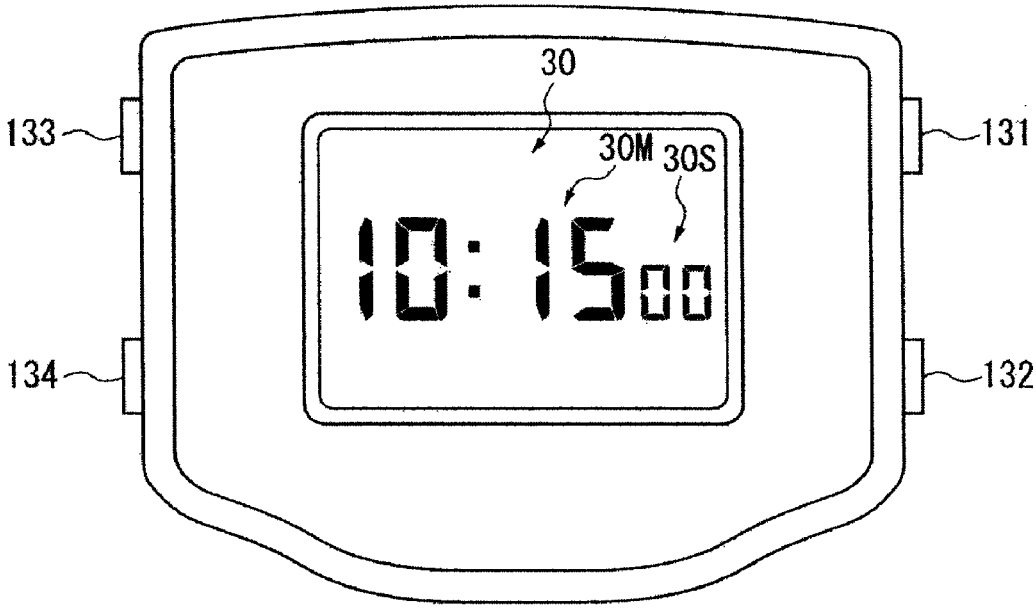
FIGS. 9A and 9B show the display in a time adjustment mode.

To start adjusting the time the user uses operating button 133, for example, to enter the time setting mode (FIG. 9A). This causes the second display unit 30S to reset to 00 s. Operating button 134, for example, is then pressed to select the minute display unit 30M for adjustment, and presses operating button 131, for example, to increment the minute one by one.

If the operation detection unit 614 (FIG. 5) detects that the operating button 131 is operated continuously for a prescribed time, such as being held depressed for 1 s ("pushed long" below), drive control by the drive control unit 61 goes from the saturation drive step S1 to the gray level drive step S2 (FIG. 13), and the minute display unit 30M counts up in gray (the gray level state in the bottom row in FIG. 13).

A change display request is applied at the time when the operating button 131 is pressed, when the saturation drive step S1 changes to the gray level drive step S2, and when the redraw display time in the gray level drive mode (T1, T2, or T3 in FIG. 8, for example) passes when the operating button 131 is held depressed. The change display request is sent from the redraw display request generating unit 627 (FIG. 6) to the saturation drive unit 625 (FIG. 6).

If the operating button 131 is released (the button turns off) while redrawing the display in the gray level drive step S2, the display stops incrementing and control goes from the gray level drive step S2 to the saturation drive step S3 (FIG. 13). This causes the display of the minute display unit 30M to go to the saturation color, black (the saturation state shown in the bottom row in FIG. 13).

After the saturation drive step S3, the operating button 131 is pressed again after a standby period (a period in which the button is not depressed) in the example shown in FIG. 13. This causes the redraw process to start in the saturation drive step S4 (D) in FIG. 13 to increment the display and the gray level drive step S5 in (E) in FIG. 13 to execute because the operating button 131 is again held depressed for the prescribed number of seconds. Because the operating button 131 is held depressed while the display is redrawn in the gray level drive step S5, the display continues to be redrawn in the gray level drive mode in the next gray level drive step S6. When the operating button 131 is then released while redrawing the display in the gray level drive step S6, the display stops incrementing and the saturation drive process S7 executes.

Figure 9B:
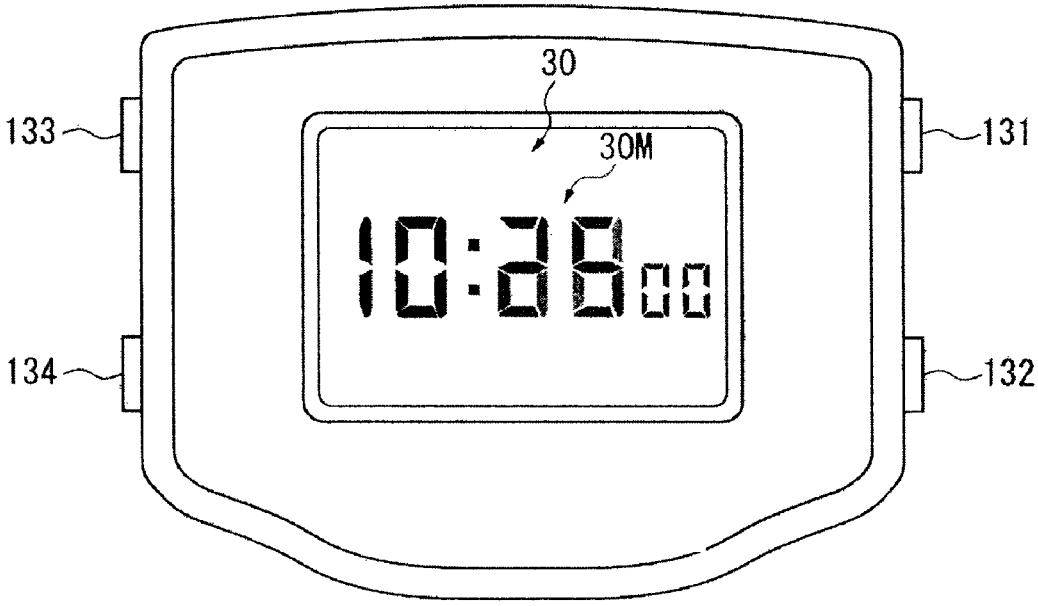

When the operating button 131 is operated (pressed long) as shown in FIG. 13 (A) to (G), the number displayed in the minute display unit 30M counts up with the segments of the minute display unit 30M displaying gray (gray level) as illustrated in FIG. 9B. The minute display unit 30M displays "25" in this example.

Figure 10A:
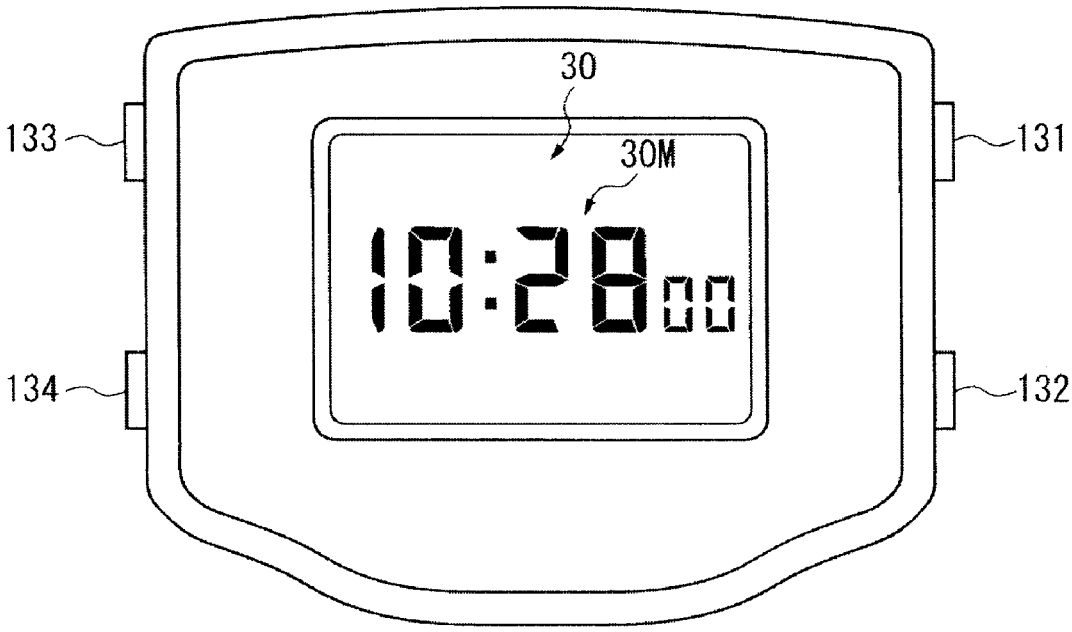
FIGS. 10A and 10B show the display in a time adjustment mode.

Furthermore, because the display is driven in the saturation drive mode the operating button 131 is released after being held depressed (pressed long), the number displayed in the minute display unit 30M turns black (saturation state) as shown in FIG. 10A, for example. The minute display unit 30M shows the number "28" at this time.

Drive control when the operating button 131 is then pressed four times consecutively to increment the display as shown in FIGS. 10B, 11A, 11B, 12A, and 12B to set the desired value of "32" minutes is described next with reference to FIG. 14. FIG. 14 shows the control sequence when the operating button 131 is pressed four times after an appropriate standby period after the saturation drive step S7.

Figure 10B:
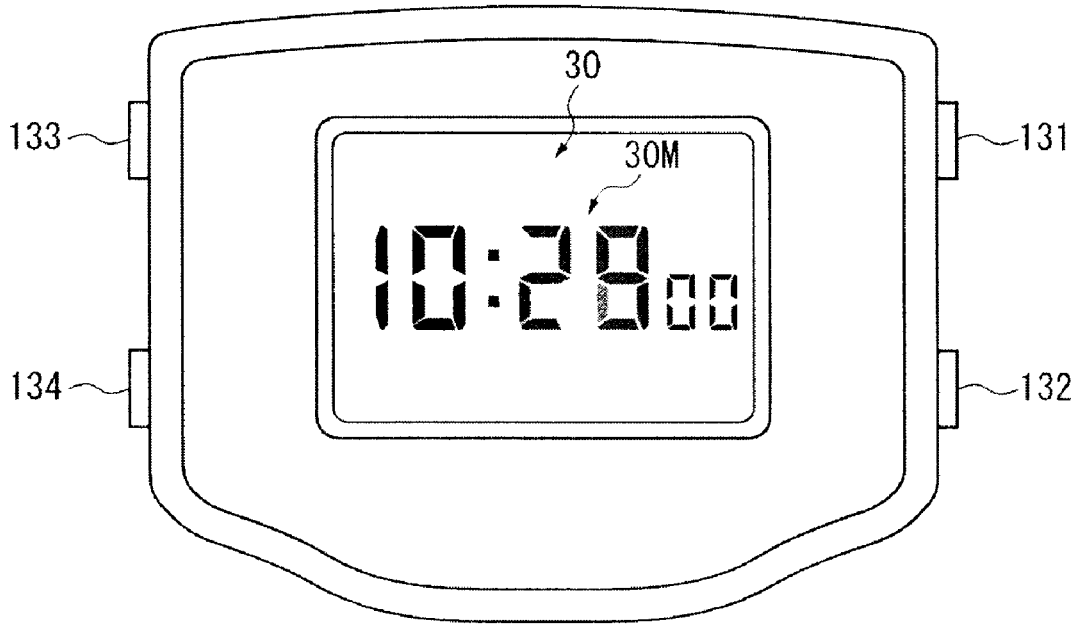

In this example the operation detection unit 614 (FIG. 5) of the drive control unit 61 detects the interval at which the operating button 131 is pressed at the timing of a reference signal having a prescribed period. More specifically, the operation detection unit 614 detects the operating intervals M1, M2, and M3 of the operating button 131 shown in FIG. 14. If operating interval M1 is shorter than the saturation time T1 (FIG. 7) that is required for the display redrawing process of the saturation drive mode, the redrawing process of the saturation drive step S11 that is writing "29" in FIG. 10B is interrupted, and drive control by the drive control unit 61 goes to the redrawing process (gray level drive step S12) for writing "30" as shown in FIG. 11A.

The gray level drive step S12 thus starts if the operating button 131 is operated at an interval M1 that is shorter than the saturation time from the last time the button was operated (i.e., the first time the button was pressed).

Because the operating interval M2 between the second and third times the button is pressed, and the operating interval M3 between the third and fourth times the button is pressed, are shorter than saturation time T1, the redrawing process (gray level drive step S13) writing "31" and the redrawing process (gray level drive step S14) writing "32" follow gray level drive step S12. This embodiment of the invention executes the display redrawing process of the gray level drive step synchronized to operation of the operating button 131, and the operating interval M2 and M3 of the operating button 131 is shorter than the time (T1, T2, and T3 in FIG. 8) required to redraw the display in the gray level drive step. Operating the operating button 131 thus interrupts the display redrawing processes of gray level drive steps S12 and S13, and triggers the next redrawing process, and the minute display unit 30M is driven to display a gray level (gray) between the saturation drive step S11 and the gray level drive step S14.

The saturation drive step S15 executes when the operation detection unit 614 detects that the operating button 131 is not operated during the display redrawing process of the gray level drive step. This saturation drive step S15 causes the number that is displayed with gray segments by the gray level drive step S14 to go to the saturation state and turn black as shown in FIG. 12B. Note that the minute display unit 30M displays black after the saturation time T1 from the start of the gray level drive step S14.

6-2 Countdown Timer

Figure 15A:
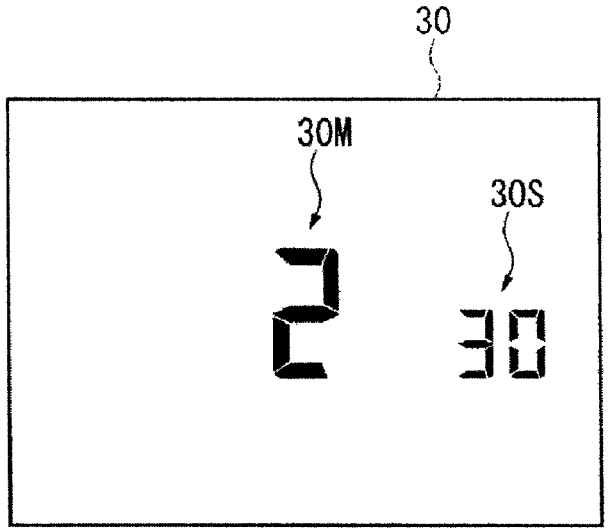
FIGS. 15A-15C show the display state when a countdown timer is operating.
Figure 15B:
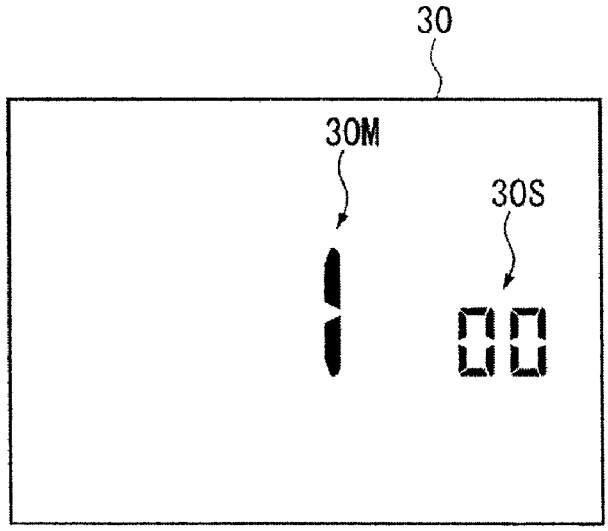
Figure 15C:
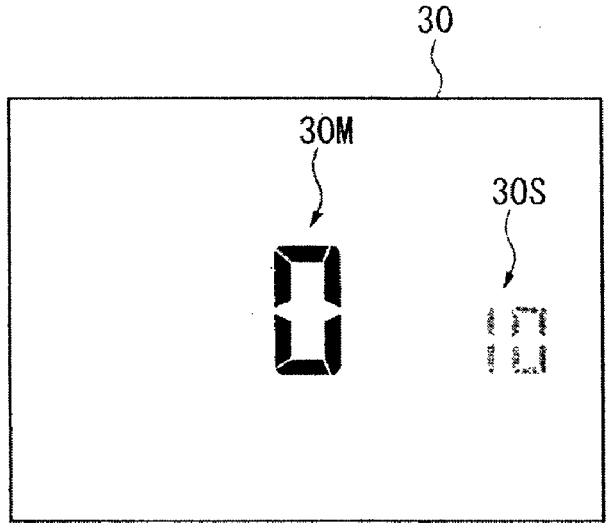
Figure 16:
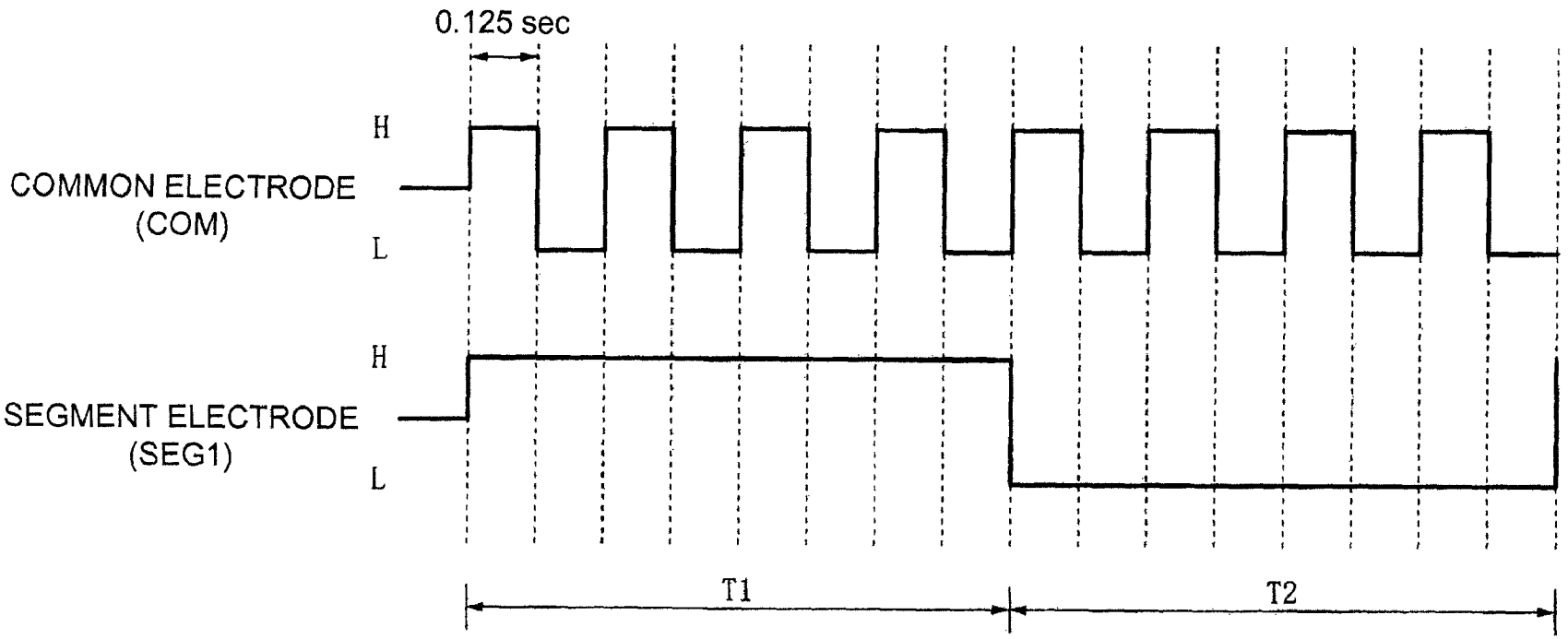
FIG. 16 shows an example of the drive signal applied to the display panel according to the present invention in a gray level drive mode.

The display when operating in a countdown timer mode is shown in FIGS. 15A-15C. In this example the timer is set to count down from three minutes and the remaining time is displayed every ten seconds. After the timer starts the minute display unit 30M and the second display unit 30S are redrawn as shown in FIGS. 15A and 15B, and both the minute display unit 30M and the second display unit 30S are driven in the saturation mode to display black until just before the state shown in FIG. 15C, that is, until the remaining time is 10 seconds. When only 10 seconds are left drive control switches from the saturation drive mode to the gray level drive mode, and the display is redrawn every second to count down from "10" seconds to "00" second. FIG. 16 shows the gray level drive mode during this countdown sequence.

Because this countdown sequence redraws the display every second, a gray level drive mode (drive periods T1, T2) that writes once by applying four pulses with a half-wavelength of 0.125 s is used. During drive period T1 the display is driven towards white, and during drive period T2 the display is driven towards black. When counting down from 10 seconds to 00 seconds, the gray level drive step shown in drive period T1, for example, executes ten times, and the saturation drive step is used to display the end value at 00 s.

6-3 Hour Announcement

Figure 17A:
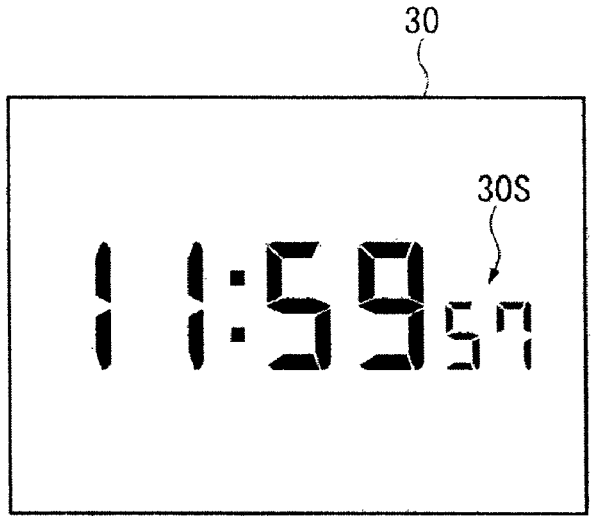
FIGS. 17A-17C show the display when announcing the hour.
Figure 17B:
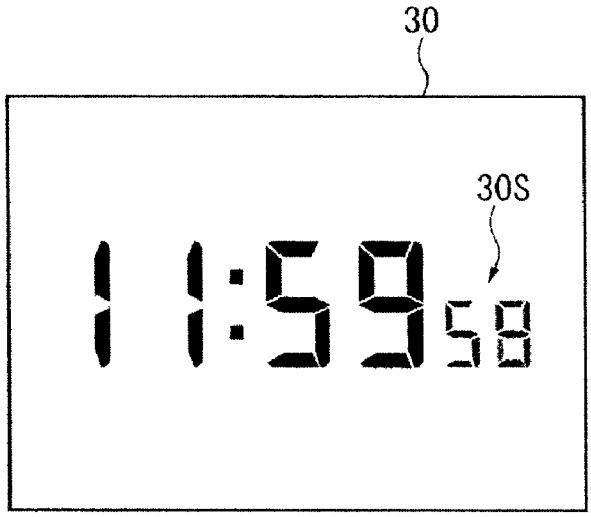
Figure 17C:
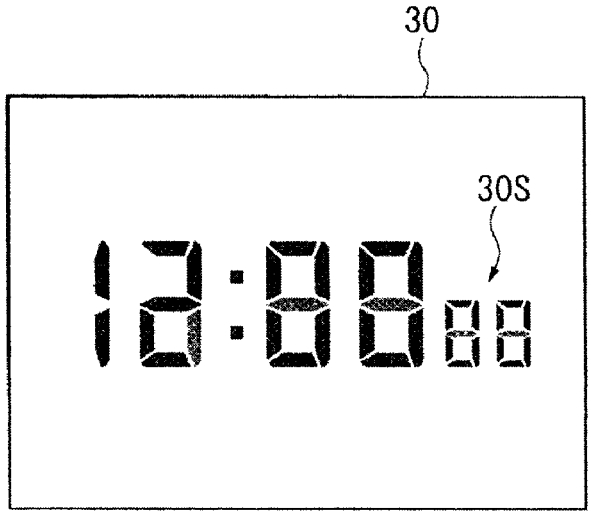

FIG. 17 shows the display when announcing the hour (such as 0:00 or 12:00). This embodiment of the invention displays the time using only the hour and minute, and does not usually display the seconds, but displays the second in the second display unit 30S using the gray level drive mode starting three seconds before the hour, such as from 11:59:57, as shown in FIGS. 17A and 17B until the time goes to the full hour as shown in FIG. 17C. The second display unit 30S is redrawn every second in this case as described in FIG. 16. At one second after the hour control switches from the gray level drive mode to the saturation drive step mode, and the second display unit 30S is redrawn to the same color as the background (white) to erase the second.

As shown in FIG. 17C, the hour display unit 30H and the minute display unit 30M are redrawn in addition to the second display unit 30S at the hour. FIG. 17C shows the gray level displayed before the display is redrawn to the display saturation color.

This embodiment of the invention only displays the second to announce the hour, but every second could also be displayed using a display panel 30 and drive control circuit board 40 as described in this embodiment of the invention. More specifically, the current time can alternatively be displayed using the hour, minute, and second.

6-4 Setting an Alarm

Figure 18A:
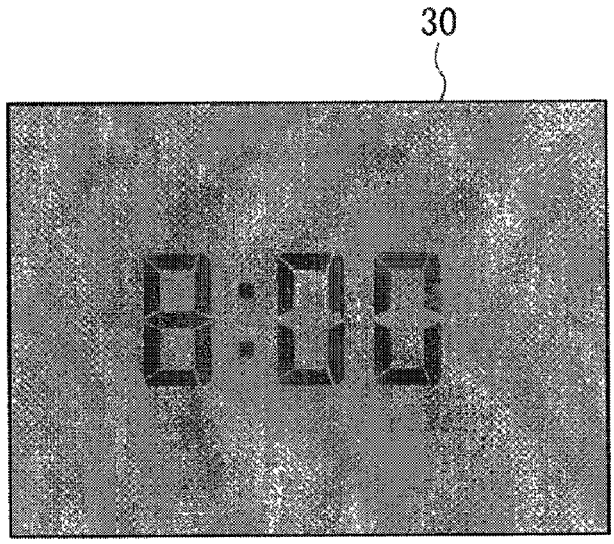
FIGS. 18A and 18B show the display when an alarm sounds.
Figure 18B:
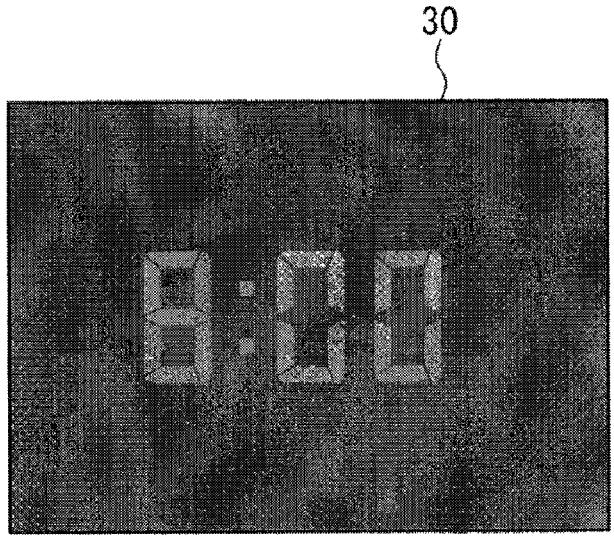

FIG. 18 shows the display when driven to show that the current time matches the alarm setting. In this example the alarm was set to go off at 8:00. When the current time reaches 8:00, the color used to display the time of 8:00 and the color displayed in the background switch repeatedly between dark gray and light gray as shown in FIGS. 18A and 18B. The display is thus inverted using the gray level drive mode until a prescribed time passes or a button is pressed, for example, and control then goes from the gray level drive to the saturation drive mode.

6-5 Chronograph Function

Figure 19A:
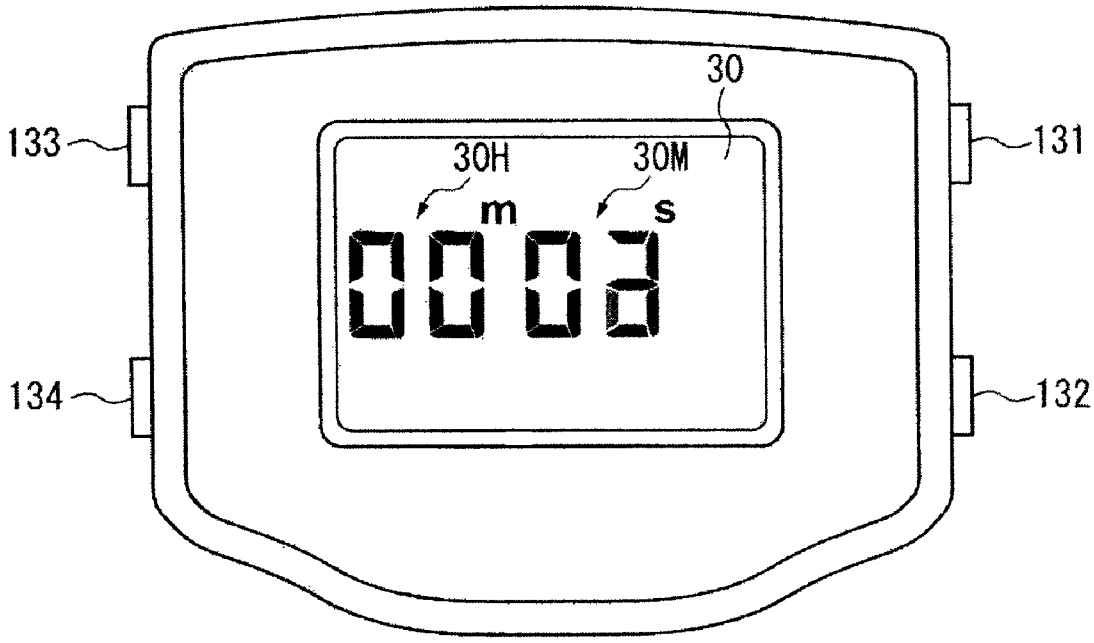
FIGS. 19A and 19B show the display when a chronograph is operating.
Figure 19B:
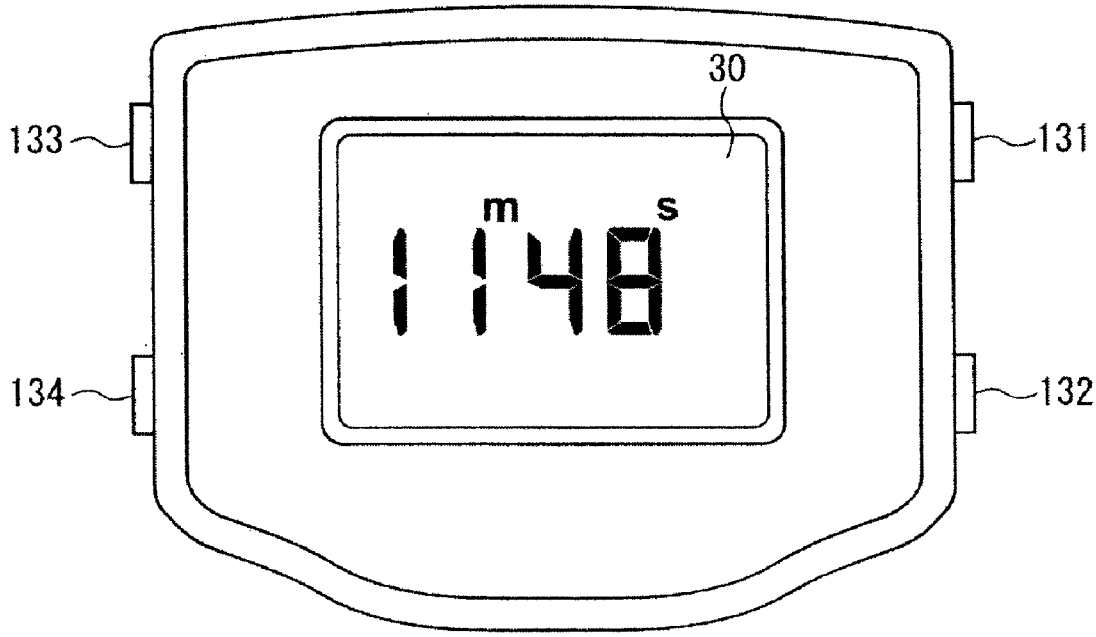

FIG. 19 shows the display when the chronograph function (stop watch) is used. When the operating button 133, for example, is operated to select the chronograph mode, the minute is displayed in the hour display unit 30H and the second is displayed in the minute display unit 30M. The counter starts counting up when an operating button 131, for example, is pressed to start counting, and the seconds digit is incremented using the gray level drive mode (FIG. 19A). When the operating button 131 is pressed again to stop the clock (FIG. 19B), the minute and second are displayed using the saturation drive mode based on the current time from an internal counter in the timepiece.

7. Effect of the Embodiment

This embodiment of the invention has the following effect and benefits.

(1) By providing a gray level drive mode (FIG. 8, for example) in the drive control of the display panel 30 of the timepiece 1, the display panel 30 is redrawn in the gray level drive mode to change the display content based on the differences in the colors displayed at an unsaturated gray level. This gray level drive mode greatly shortens the display writing time particularly when it is necessary to continuously quickly change the display, and reduces power consumption compared with an arrangement that always operates in the saturation drive mode.

(2) Because the saturation drive mode (FIG. 7) is also used to drive the display panel 30, the gray level display of the gray level drive mode is driven to the maximum reflectivity level of the display in the saturation state resulting from the saturation drive mode. The display can thus be changed in a short time while also improving display readability when the display state is held.

(3) The drive device of the display panel 30 has a single power supply (FIG. 5 and FIG. 6) and is driven at two potential levels, HIGH (+15 V) and LOW (0 V), and can therefore be driven on a time-share basis to switch from black to white or from white to black. The drive device can thus be rendered with a small circuit arrangement suitable for use in a portable timepiece 1 while efficiently shortening the display redrawing time using single power supply drive, which typically takes longer to redraw the display.

(4) The display drive unit 62 (FIG. 6) has a redraw display request generating unit 627, and executes the next display process when a change display request is asserted (FIG. 13) while redrawing the display in the saturation drive mode or the gray level drive mode. More specifically, the time required to redraw the display can be shortened by switching to the next display process from the gray level before the saturation state is reached instead of waiting until the saturation state is achieved.

(5) This embodiment of the invention counts how long one of the operating buttons 131 to 134 is operated continuously, determines that the user wants to select a particular item or set the time, for example, if the button is operated continuously for approximately two seconds, and therefore starts the gray level drive mode. Driving the display in the gray level drive mode can therefore start appropriately linked to user operations, and the user can watch the setting change.

(6) This embodiment also determines that the user has stopped item selection or setting the time when the button is then released, and therefore enters the saturation drive mode (S3 in FIG. 13). In addition, if the button is operated again before the saturation state is reached, the next display process is executed according to the change display request D (S5 and S6 in FIG. 13). The display can thus be driven appropriately based on the user's actions. More specifically, the display can be changed as the operating buttons 131 to 134 are pressed repeatedly, enabling the user to verify the changed setting while operating the buttons.

(7) Starting the gray level drive mode is not limited to when an operating buttons 131 to 134 is operated. More specifically, the gray level drive mode can be started at a specific time or when a specific condition is met, such as when the current time reaches the hour (FIG. 17) or the current time matches the alarm setting (FIG. 18), and control can then switch automatically to the saturation drive mode from the gray level drive mode at a specific time or when a specific condition is met, thus further improving the effect of shortening the display redrawing time.

(8) Even if the saturation drive time required to reach the saturation state (drive period T1 in FIG. 7) is longer than one second, the drive period T1 in the gray level drive mode (FIG. 8) is less than or equal to one second. As a result, the second can also be displayed using the gray level drive mode.

(9) When the operating interval M1, M2, M3 of the operating button 131 is shorter than the saturation time T1, this embodiment of the invention determines that the user wants to consecutively change the display and therefore executes gray level drive steps S12, S13, S14. The display can thus be rapidly redrawn substantially synchronized to the user repeatedly pressing the operating button 131.

Embodiment 2

A second embodiment of the invention is described next with reference to FIG. 20 to FIG. 24. The foregoing first embodiment uses a segment drive type display panel 30 and drive control circuit board 40. The display module 5 in this embodiment of the invention, however, is an active matrix TFT (thin film transistor) display.

The display module 5 includes a display panel 50 that is an electrophoretic display device, and a drive device not shown. The display panel 50 has an electrophoretic layer containing microcapsules 330 (FIG. 4) disposed between a transparent substrate with a common electrode and a TFT substrate, and further detailed description of the display panel 50 is omitted. Pixel electrodes arranged in a matrix are rendered on the TFT substrate. By switching the TFT based on the picture signal input, voltage is applied between a pixel electrode and the common electrode.

Figure 20:
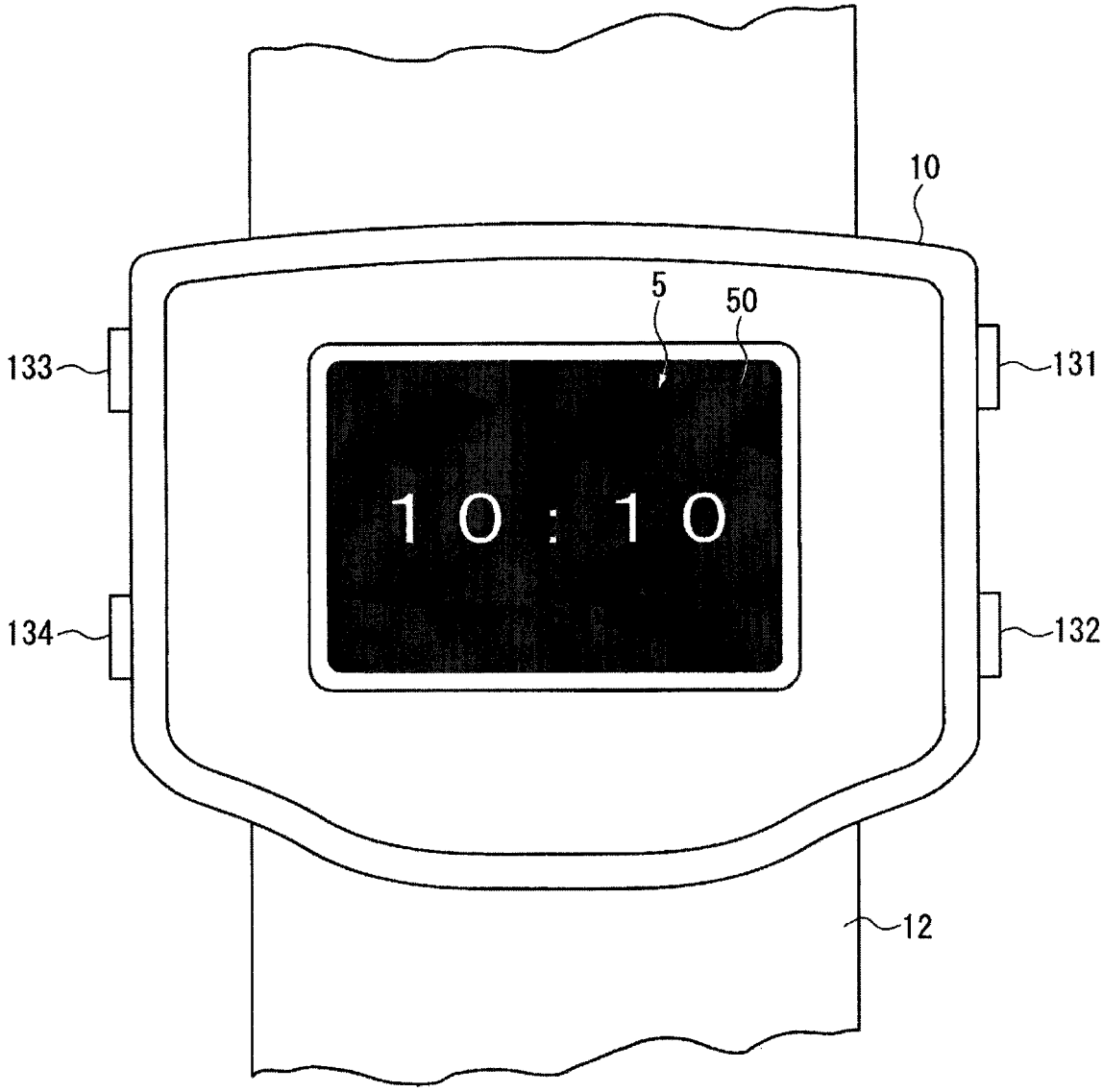
FIG. 20 shows a timepiece according to a second embodiment of the invention when the time is displayed.
Figure 21:
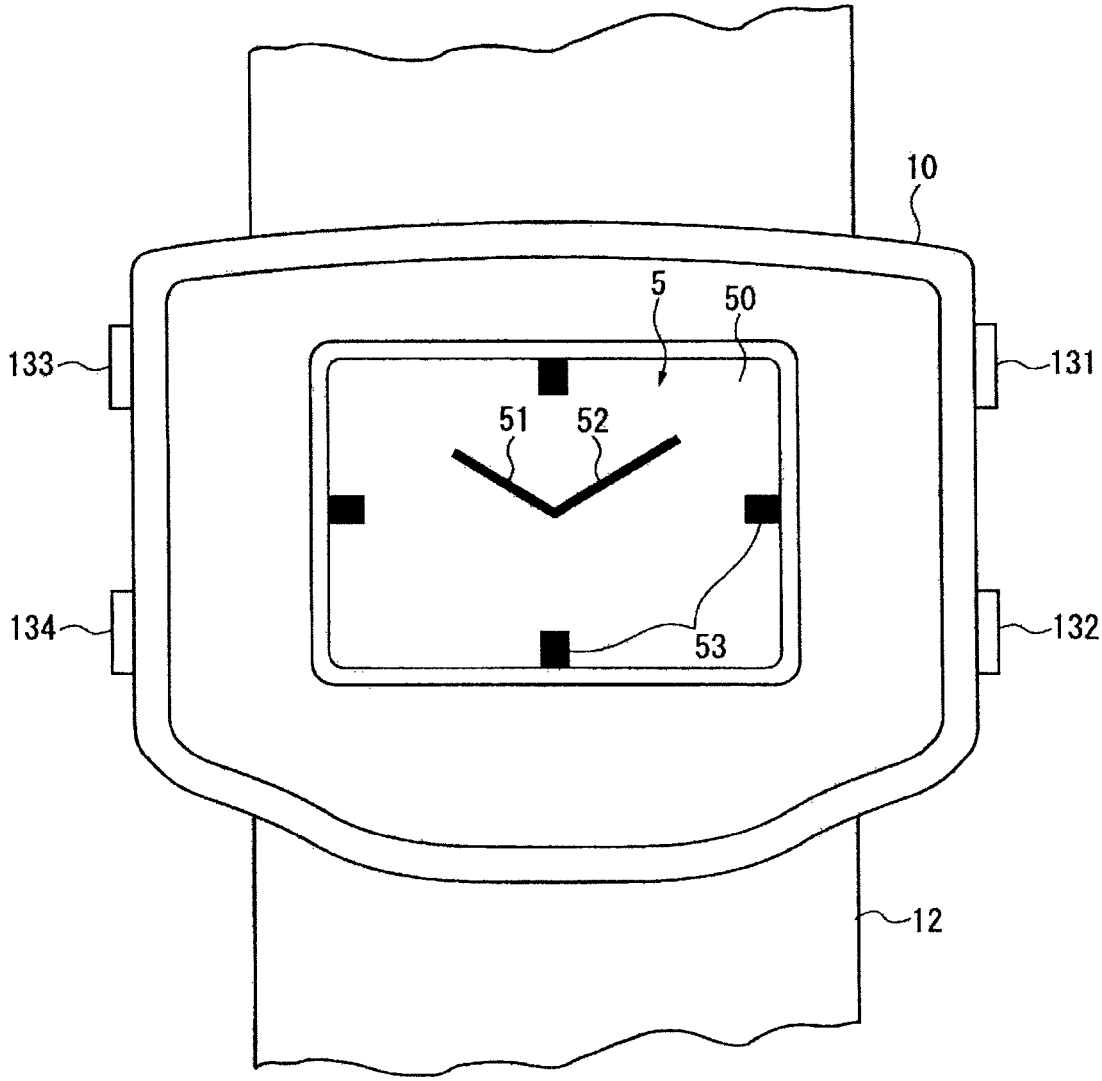
FIG. 21 shows the timepiece of the second embodiment in a different time display mode.

A timepiece according to this embodiment of the invention can display time in various ways, including a digital time display using numbers as shown in FIG. 20 and an analog time display using an hour hand 51 and a minute hand 52 displayed digitally on a digital panel as shown in FIG. 21. When the time is displayed using an hour hand 51 and minute hand 52, markers 53 are also displayed around the outside of the display panel 50. The display is wiped when switching between the display mode shown in FIG. 20 and the display mode shown in FIG. 21. For example, when changing the display from the analog mode shown in FIG. 21 to the digital mode shown in FIG. 20, the hour hand 51, minute hand 52, and markers 53 in FIG. 21 are sequentially cleared (wiped out), and the numbers in FIG. 20 are sequentially displayed (wiped in).

Figure 22:
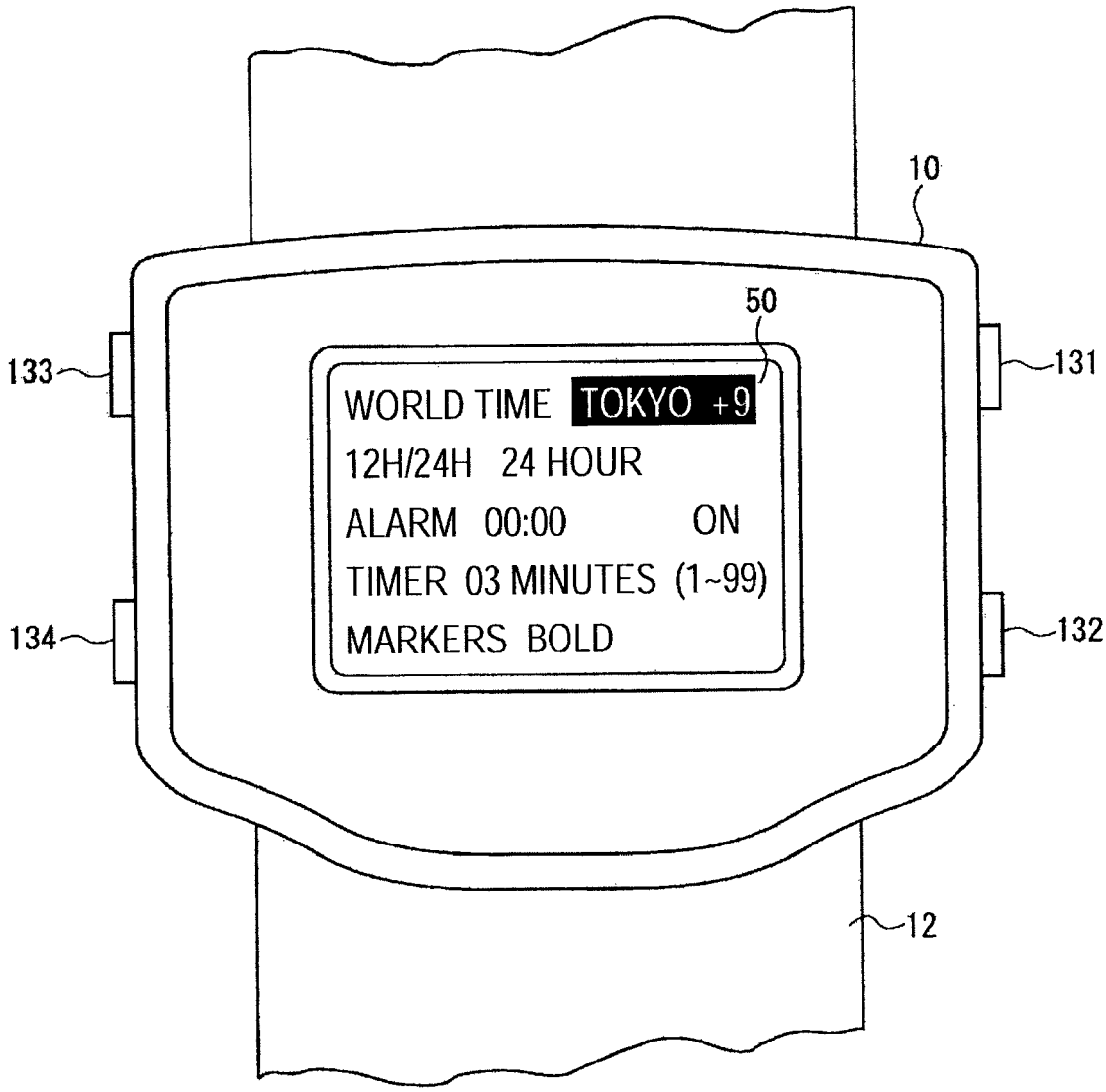
FIG. 22 shows a setup screen of the timepiece of the second embodiment.

FIG. 22 shows the setup screen for configuring various functions of the timepiece according to this embodiment of the invention. This example shows selecting a city to set the world time zone, and operating buttons 131 and 132 are used to change the city. More specifically, operating button 131 is pressed to select a city that increases the time difference, and operating button 132 is pressed to select a city that decreases the time difference.

The same method can be used to set functions other setting a city for the world time function.

Figure 23:
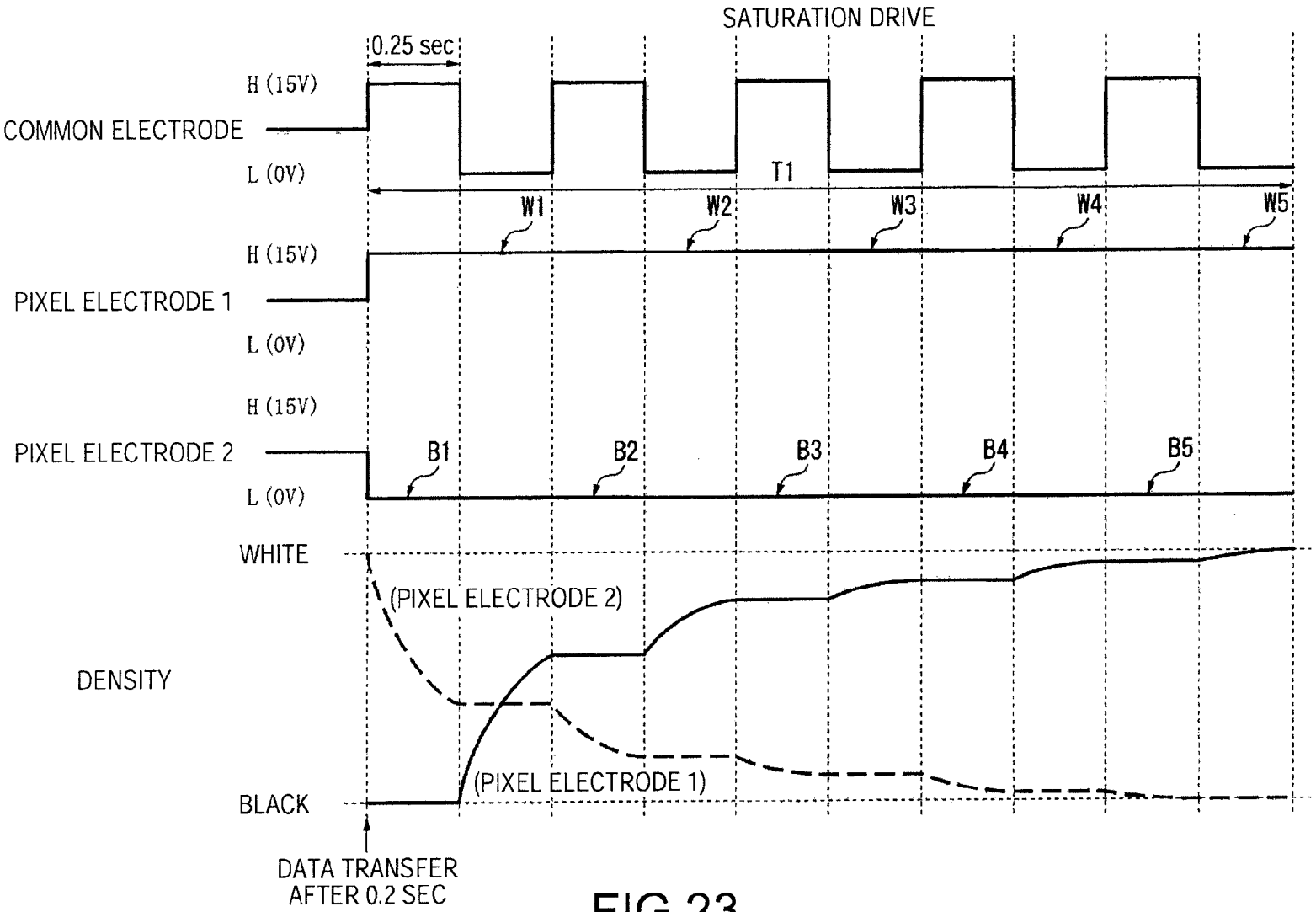
FIG. 23 shows a drive signal of a display panel in a saturation drive mode.
Figure 24:
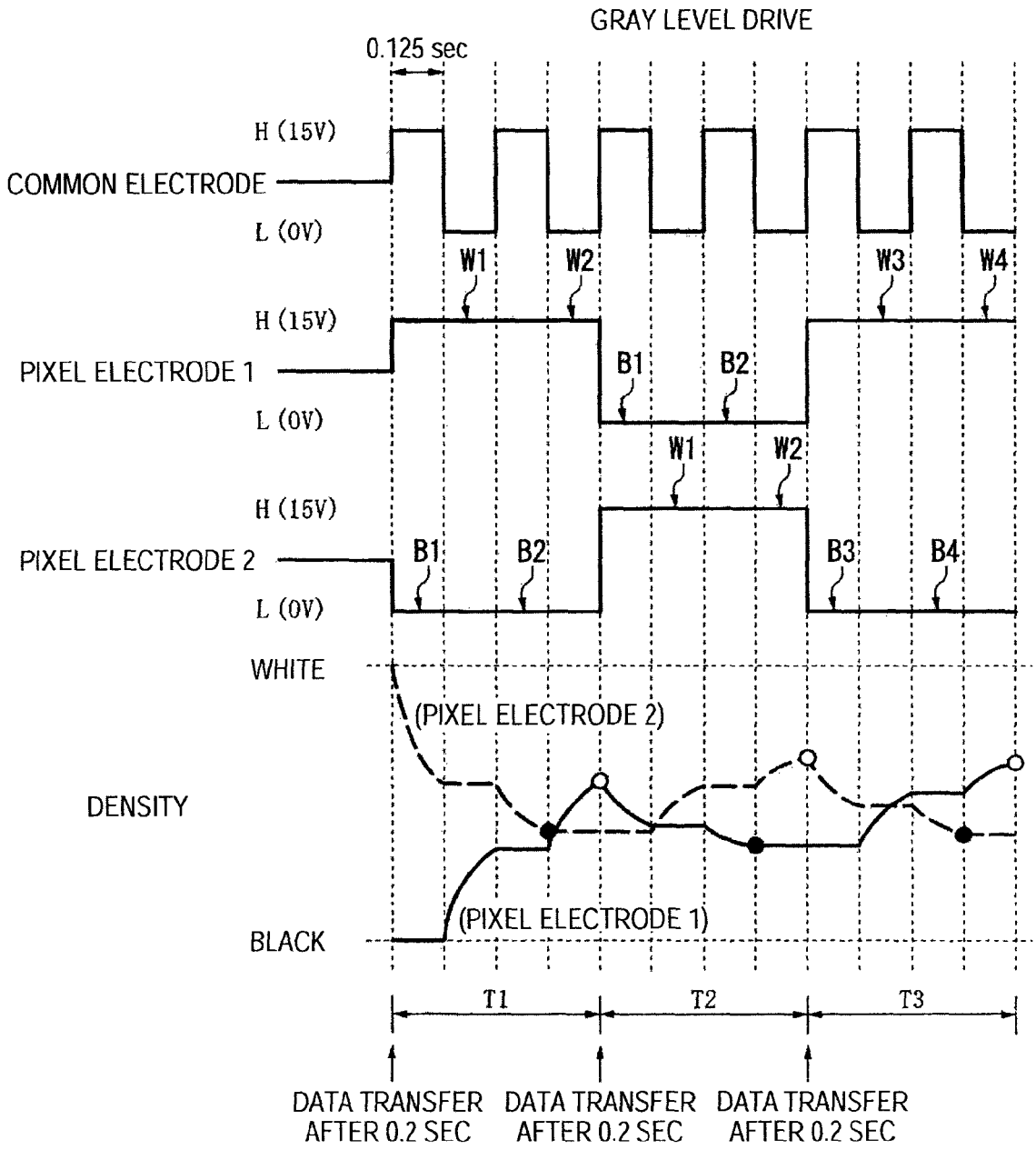
FIG. 24 shows the drive signal of the display panel in a gray level drive mode.
Figure 25:
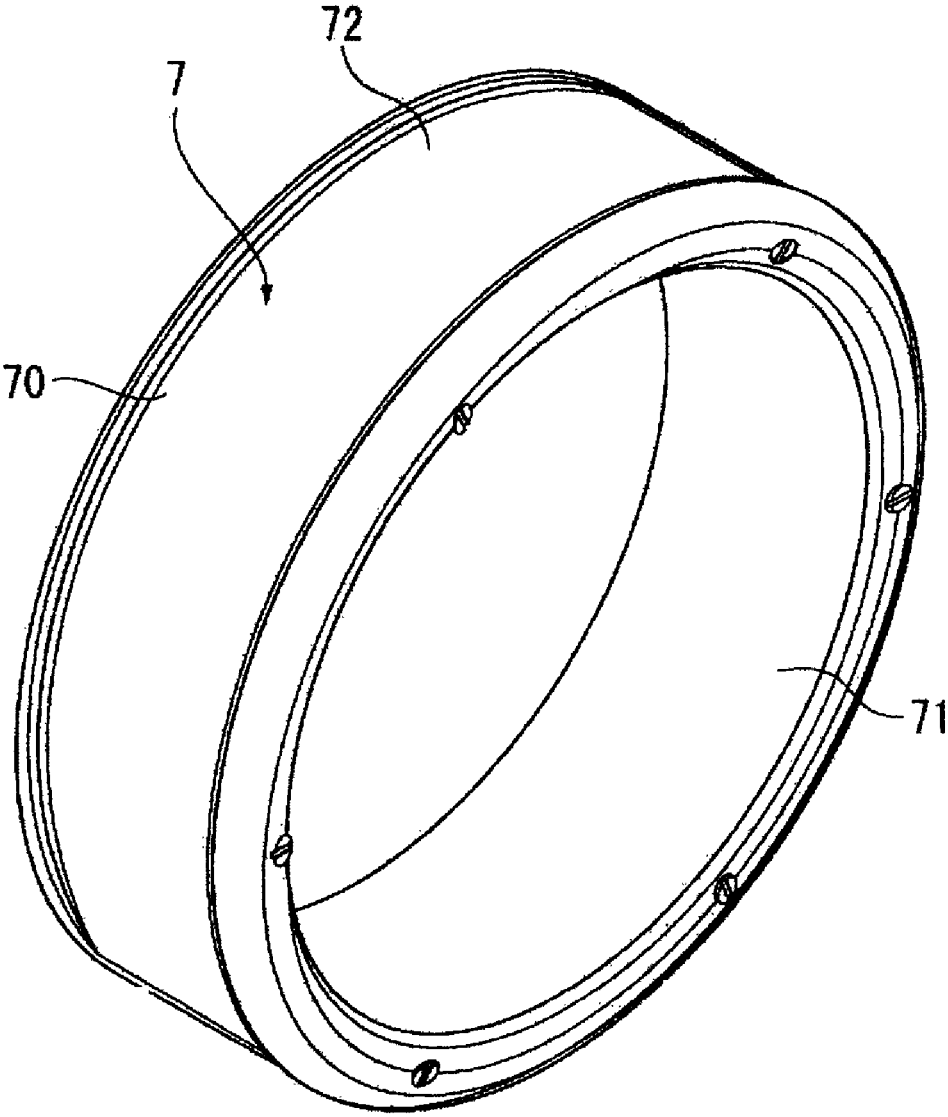
FIG. 25 shows a timepiece according to a third embodiment of the invention.

FIG. 23 and FIG. 24 describe driving pixels of the display panel 50. The time is displayed as shown in FIG. 20 and FIG. 21, and the display is driven when changing settings as shown in FIG. 22, using the saturation drive process shown in FIG. 23 or the gray level drive process shown in FIG. 24 by way of example. For example, when displaying the current time as shown in FIG. 20 and FIG. 21, the saturation drive mode is used. When changing between the time display modes shown in FIG. 20 and FIG. 21, the gray level drive mode is used to rapidly rewrite the display and achieve a more natural wiping action.

If the operating button 131 is pressed and held for two seconds, for example, when changing the city (region) setting as shown in FIG. 22, control goes from the saturation drive mode to the gray level drive mode so that the user can switch rapidly between the available selections. When the operating button 131 is then released, control reverts to the saturation drive mode.

As described in the first embodiment, the half-wavelength of the common electrode drive pulse in the saturation drive mode is 0.25 s, and the half-wavelength of the common electrode drive pulse in the gray level drive mode is 0.125 s. Because this embodiment uses a TFT display, however, time is needed to send data from the driver to each pixel electrode, the sum of the drive period (such as T1) plus this data transfer time is the time required to rewrite the display. The data transfer time in this embodiment of the invention is approximately 0.2 s. While drive periods T1 to T3 are shown contiguously in FIG. 24, in practice additional data transfer time is also required in each drive period.

More specifically, however, some amount of signal transfer time is also required by the drive method of the first embodiment, and the drive methods of the first embodiment and this embodiment are therefore functionally the same. This embodiment of the invention therefore also affords the same effect and benefits as the first embodiment.

Embodiment 3

A third embodiment of the invention is described next with reference to FIG. 25 to FIG. 30. A timepiece according to this embodiment of the invention is a ring-shaped bangle watch that has a flexible display panel 70 wrapped around the outside of an annular case 71. The display panel 70 in this embodiment of the invention is a segment-drive electrophoretic display device as described in the first embodiment, and is driven by the same method described in the first embodiment. However, the timepiece according to this embodiment also has an animation function for displaying a moving picture around the 360° circumference of a large display panel 70. The display module 7 including the display panel 70 and drive device 80 (FIG. 26) is disposed between the case 71 and the crystal 72.

Figure 26:
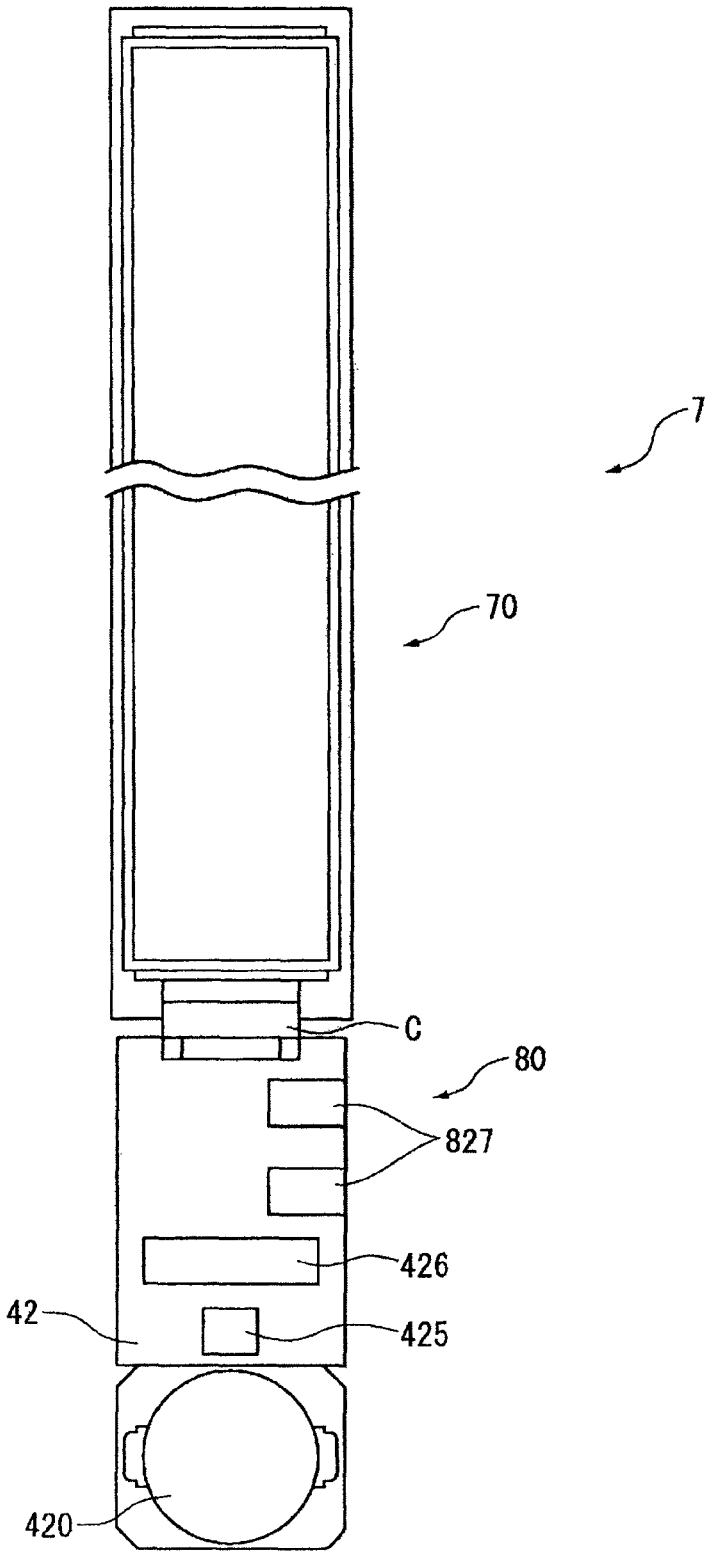
FIG. 26 is a plan view of a display module in the third embodiment of the invention.

FIG. 26 shows the display module 7. The arrangement of the display panel 70 and the drive device 80 is substantially the same as the arrangement of the display panel 30 and the drive control circuit board 40 (FIG. 2) in the first embodiment, and further description thereof is thus omitted. Operating buttons 73, 74 (FIG. 30) are disposed to the case 71, and operation of the operating buttons 73, 74 is detected by corresponding touch sensors 827.

Figure 27:
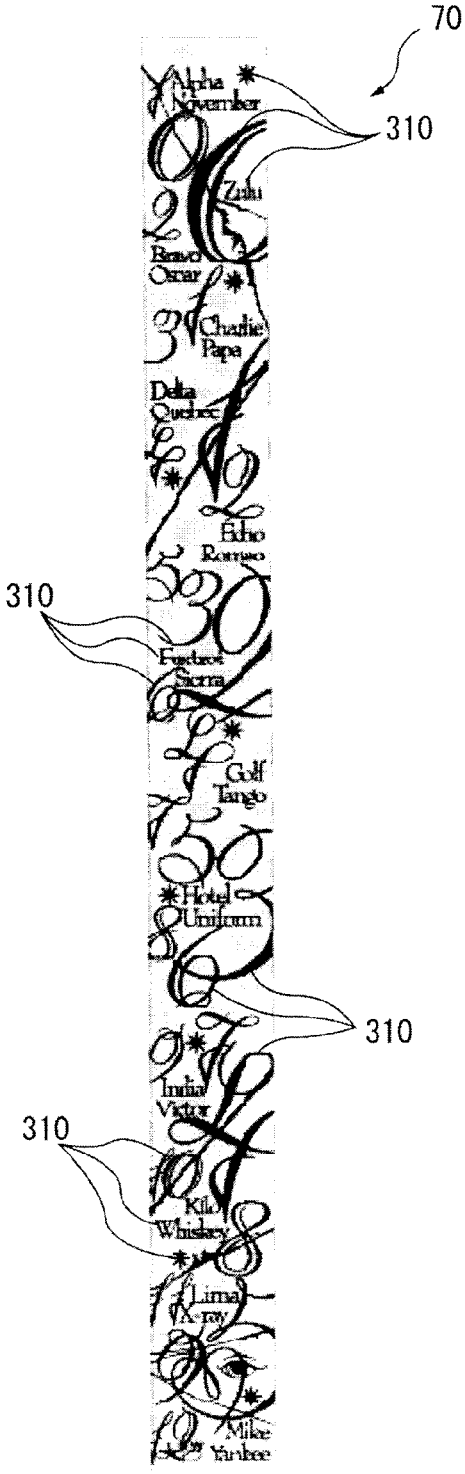
FIG. 27 is a plan view of the display panel in the third embodiment of the invention.

FIG. 27 shows substantially all of the segment electrodes 310 disposed to the display panel 70 displaying black. Numbers denoting the hour and the tens and ones digits of the minute, and letters denoting the time code, arrayed along the circumference (lengthwise as seen in FIG. 27) of the display panel 70.

In the normal time display mode numbers denoting the hour and the tens and ones digits of the minute of the current time are highlighted in black or white depending upon the color of the background, and other numbers are displayed decoratively in gray.

The timepiece according to this embodiment of the invention has a function for displaying the hour with animation. At ten seconds before the hour, for example, the display changes from the normal mode to the animation mode, and the display changes from the saturation drive mode to the gray level drive mode.

Figure 28:
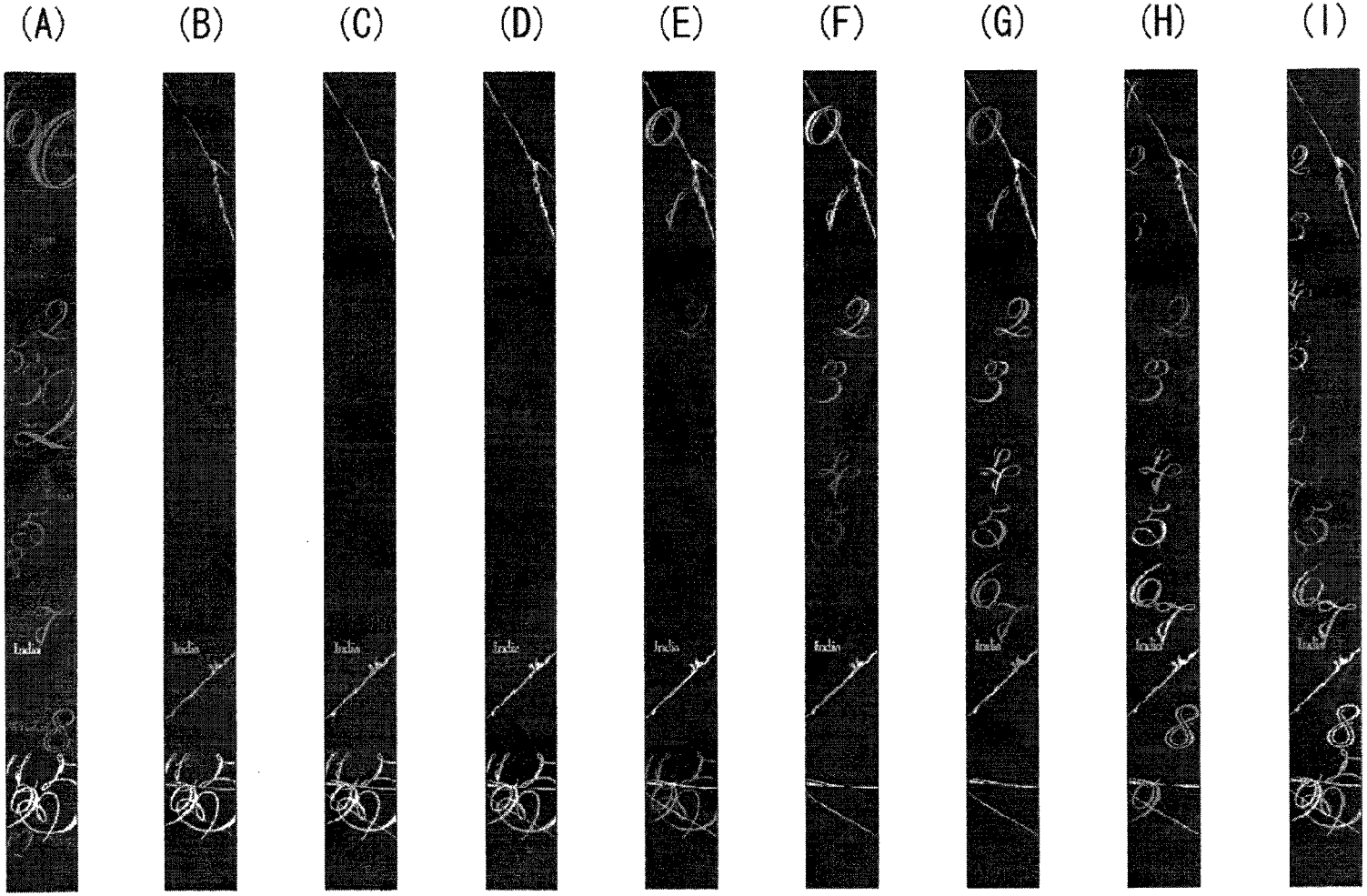
FIG. 28 shows animation in the third embodiment of the invention.
Figure 29:
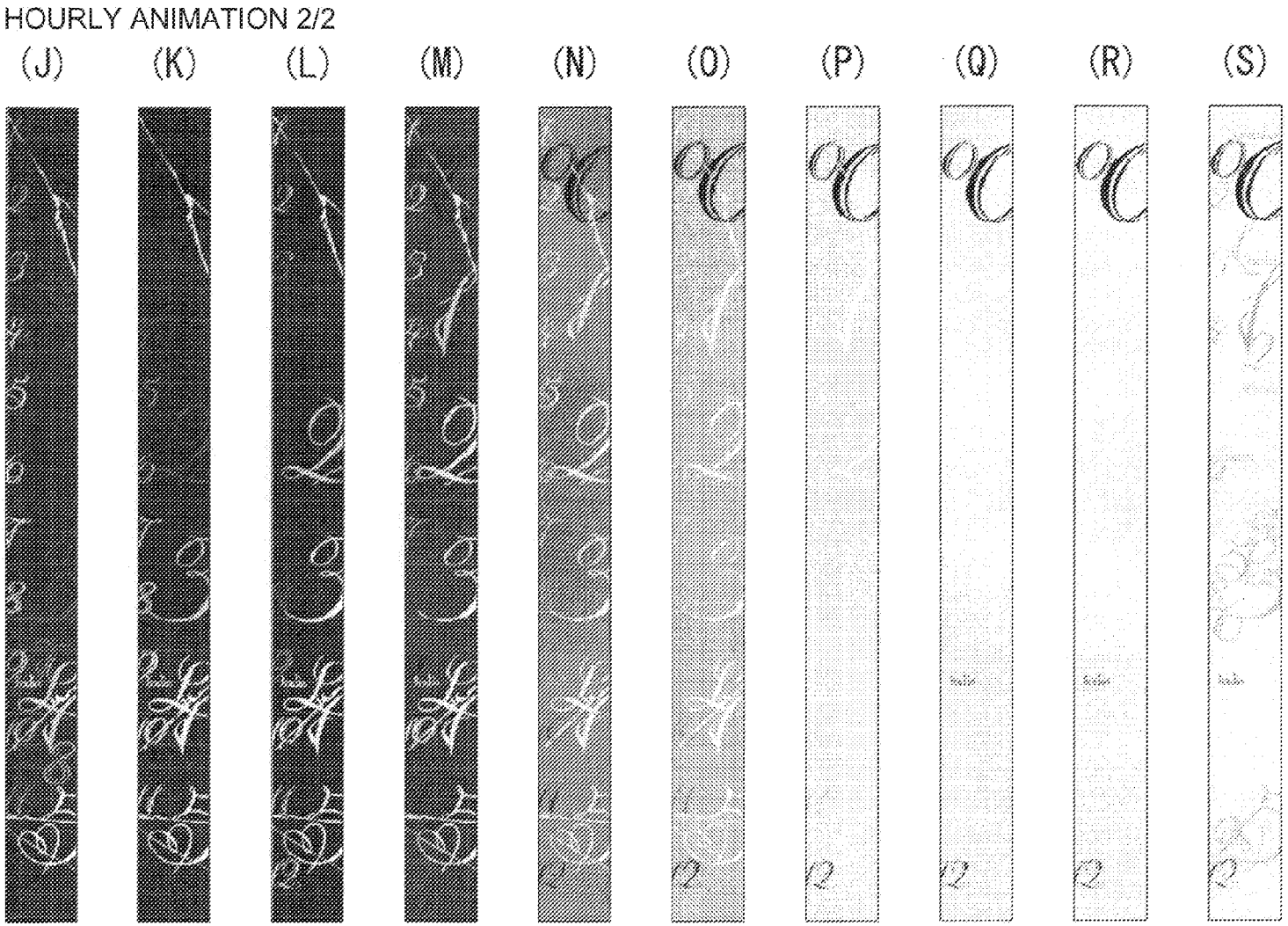
FIG. 29 shows animation in the third embodiment of the invention.

This animation is rendered by a sequence of images as shown in (A) to (S) in FIG. 28 and FIG. 29 that are displayed by rapidly changing the display in the gray level drive mode. As shown in these figures, the display color of the numbers and letters denoting the time is changed at least once at a suitable time offset.

The gray level drive process used for this animation is the same as described in FIG. 8 with the half-wavelength of the COM pulse and the drive time set appropriately. The animation ends at the hour, and the time at the hour, such as 12:00, is displayed by the saturation drive mode (FIG. 29 (S)).

Figure 30:
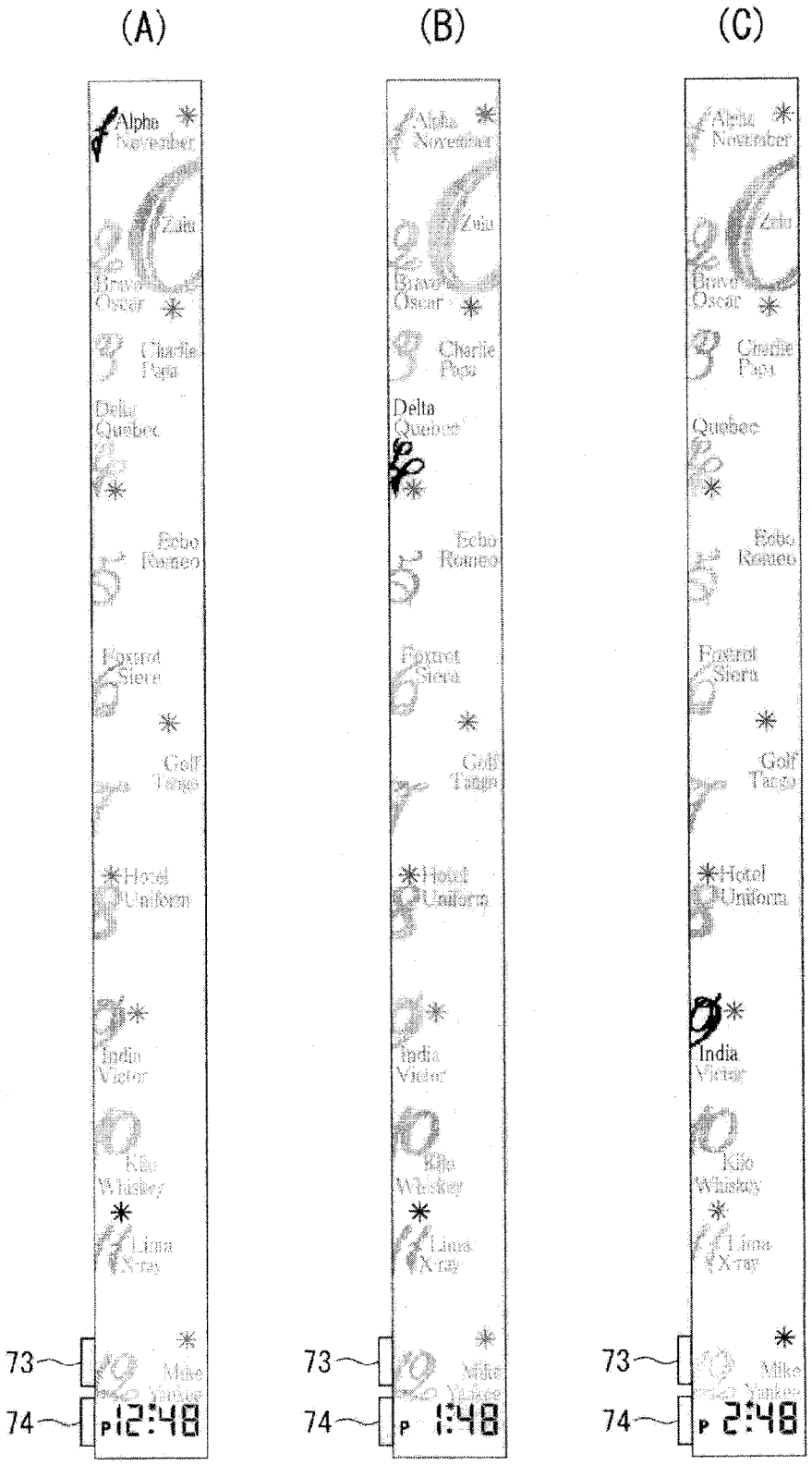
FIG. 30 shows setting a city time zone in the third embodiment of the invention.

FIG. 30 shows the display in the city setting mode of the world time function. Pressing operating button 74 adds to the time difference, and a number and time zone (displayed with a phonetic code in this example) indicating the time difference are highlighted in black against a white background. Pressing operating button 73 decreases the time difference, and a number and time zone indicating the time difference are highlighted in black. In FIG. 30 pressing the operating button 74 increases the time difference from time difference of +1 shown in (A) to the times shown in (B) and (C). Holding the operating button 74 depressed for approximately two seconds changes from the saturation drive mode to the gray level drive mode, and the selected city changes consecutively. A change display request asserted before the saturation state is reached starts the next display process, and the selected city changes rapidly while adjusting the time zone.

This embodiment of the invention affords the same effect and benefits as the first embodiment.

Other Variations of the Invention

The invention is not limited to the embodiments described above and can be varied in many ways without departing from the scope of the accompanying claims.

Figure 31:
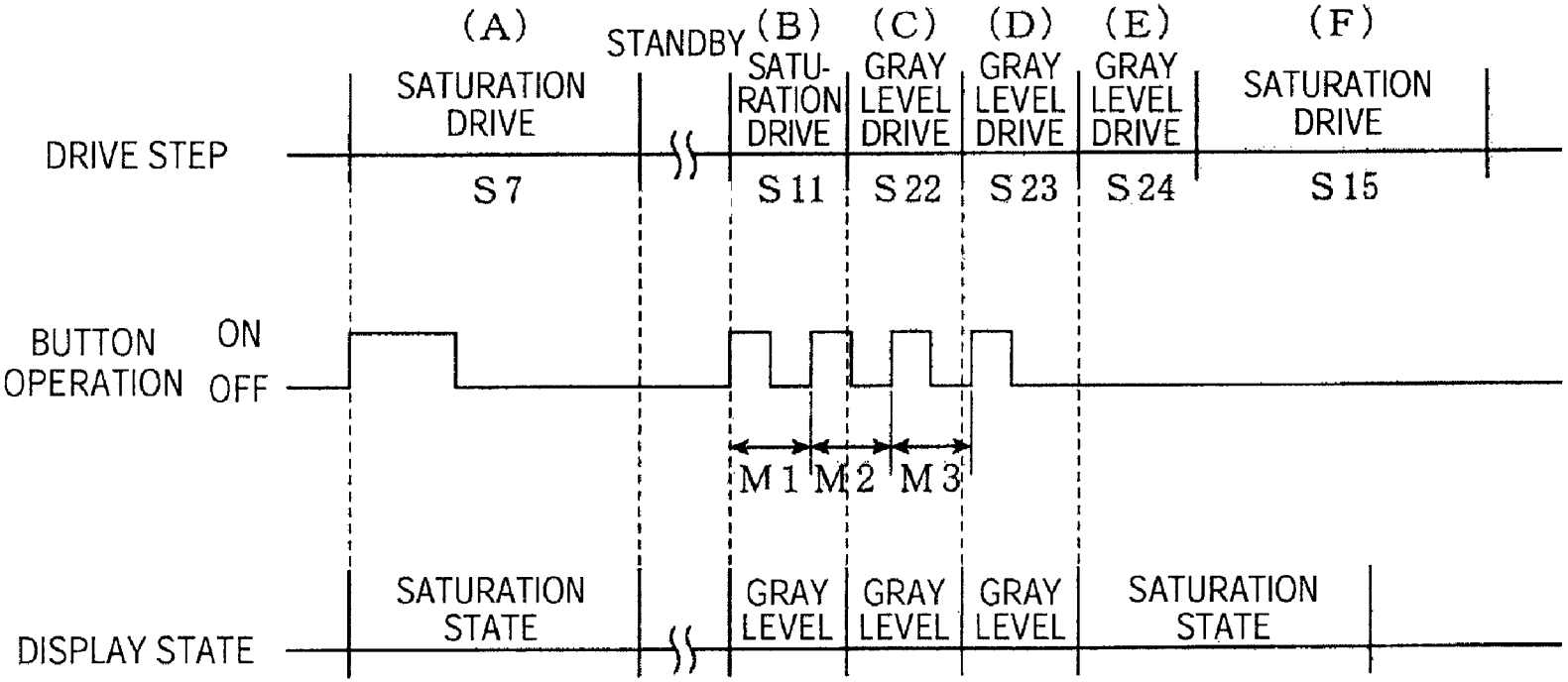
FIG. 31 shows changing the drive mode in an alternate embodiment of the invention.

FIG. 31 shows a variation of the drive control when the operating button 131 is pressed repeatedly. In this example the operating button 131 is pressed four times intermittently after the standby period following the saturation drive step S7 as shown in FIG. 14 in the first embodiment. Unlike the case shown in FIG. 14, however, the display redrawing process of the gray level drive mode is not synchronized to operation of the operating button 131.

In this example the number of times the operating button 131 is operated is detected by the operation detection unit 614 (FIG. 5) and stored in the storage unit 616 (FIG. 5). If the operating button 131 is operated at an interval M1 that is shorter than the saturation time T1 (see FIG. 7), the display writing process of the saturation drive step S11 is interrupted, and the display redrawing process of the gray level drive mode (the process in T1, T2, and T3 in FIG. 8) is repeated one time less, that is, three time, than the number of times the button was operated (that is, four times in this example).

The display writing process in the gray level drive step S22, S23, S24 is thus not interrupted by pressing the operating button 131, and is repeated a number of times that is determined by how many times the operating button 131 was operated. When the writing process (gray level drive step S24) corresponding to the last time the button was operated (the fourth time) ends, the drive control unit 61 executes the saturation drive step S15.

The storage unit 616 resets the count after the display is redrawn by the gray level drive step S24.

This embodiment of the invention reliably redraws the display the same number of times the operating button 131 is pressed, and enables the user to visually confirm the change in display state caused by pressing the operating button 131.

Figure 32:
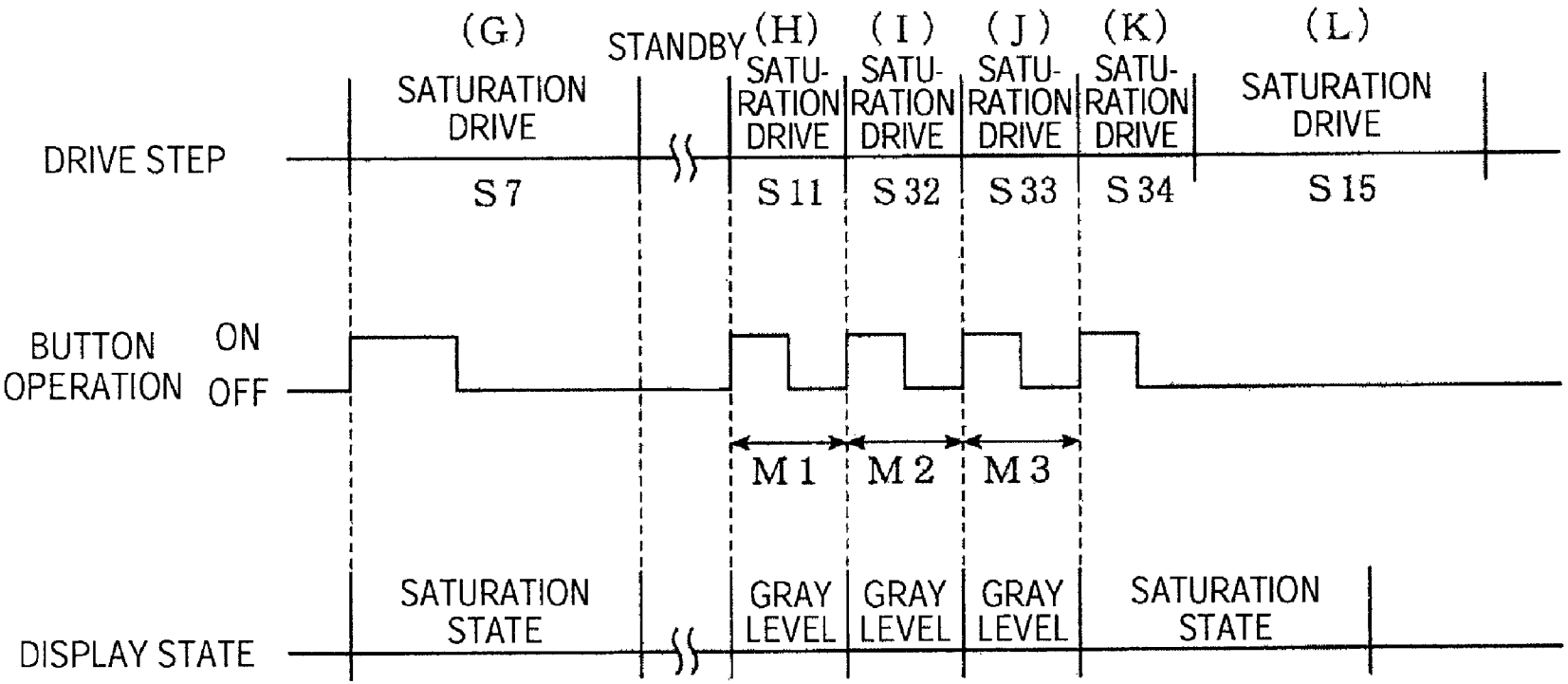
FIG. 32 shows changing the drive mode in an alternate embodiment of the invention.

FIG. 32 shows another variation of repeatedly pressing the operating button 131. In the first embodiment the display is redrawn by the gray level drive steps S12 to S14 when the operating button 131 is pressed repeatedly at a short interval. As shown in FIG. 32, however, the display can be redrawn in the saturation drive mode S32 to S34 when the button is operated repeatedly.

Figure 33:
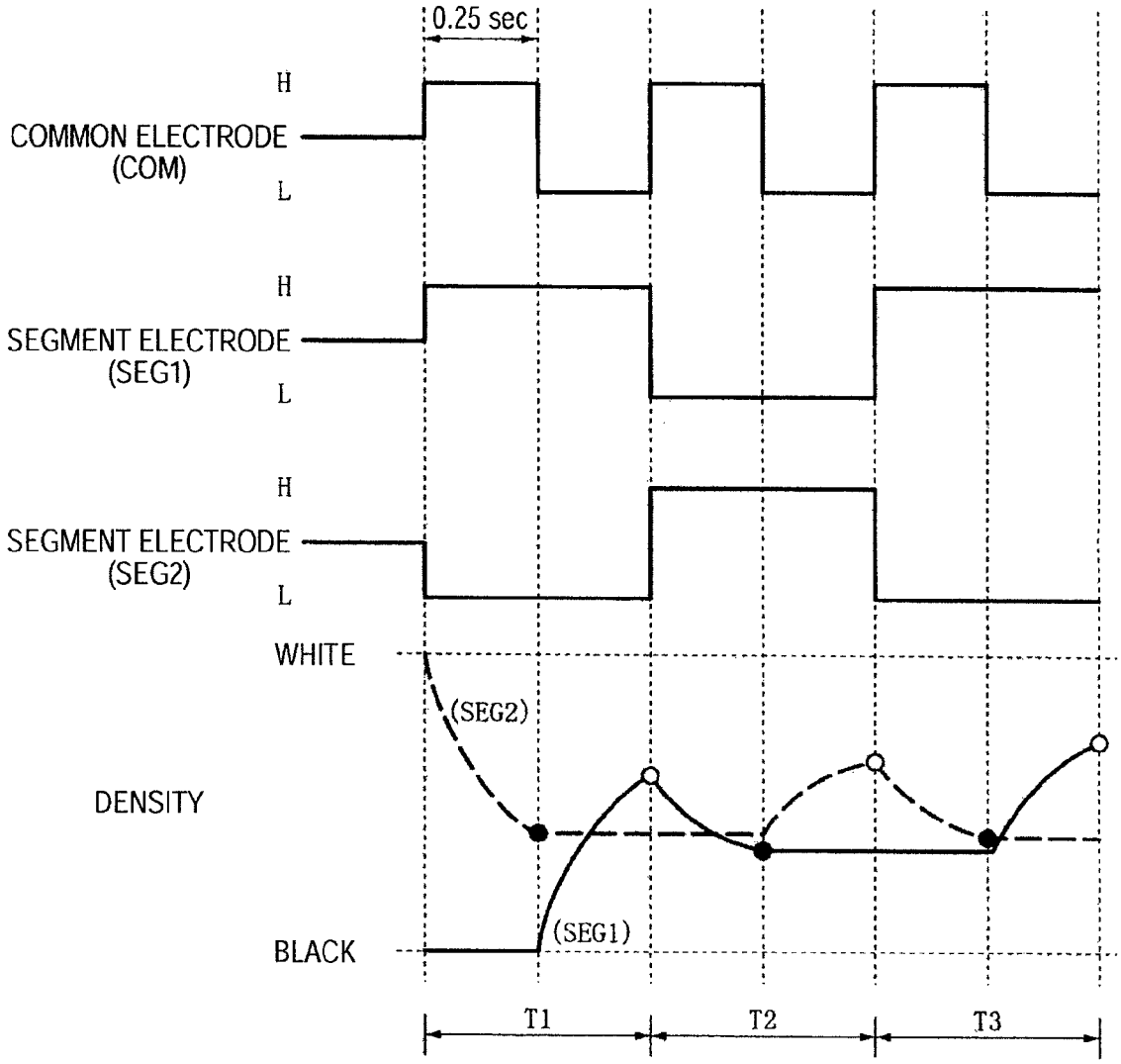
FIG. 33 shows the drive signals in the display panel in an alternate embodiment of the invention in a gray level drive mode.

FIG. 33 shows an example of the gray level drive mode in which the pulse half-wavelength is 0.25 s or twice the half-wavelength shown in FIG. 8, and the display is redrawn once in a set of two half-wavelengths. This drive method is also possible because the display can be read from the color differences produced by the drive periods T1 to T3. However, because the half-wavelength is long, the display changes may be more conspicuous depending upon the visual acuity of the user. The half-wavelength of the drive pulse is therefore preferably as short as enables causing the particles to migrate.

The drive pulse width is constant in the embodiments described above, and the HIGH potential application time and LOW potential application time are the same. The invention is not so limited, however, and the pulse width can be changed or the HIGH and LOW potential application times can differ according to the drive conditions and the characteristics of the display device.

An hour hand 51 and minute hand 52 are drawn on the display panel 50 in the second embodiment (FIG. 20) described above. Instead of digitally displaying an hour hand 51 and minute hand 52 as described above, however, an analog movement with an hour hand and a minute hand could be disposed to the display panel, and the time could be displayed with a conventional analog movement by driving the hands with a wheel train. An analog time display using mechanically driven hands could then be combined with a digital information display on the display panel. In this case the hands are mounted on a rotary pin passing through the thickness of the display panel, and the drive wheel train connected to this rotary pin is disposed on the back side of the display panel.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

The entire disclosure of Japanese Patent Application Nos: 2007-018424, filed Jan. 29, 2007 and 2007-247207, filed Sep. 25, 2007 are expressly incorporated by reference herein.

What is claimed is:

1. A drive method for a display device that displays by causing charged particles to migrate by applying an electric field, comprising:

a gray level drive step of causing the particles to migrate to, and be maintained within, a gray level state that is not a saturation level state, said saturation level state being a level at which migration of the particles is saturated;

wherein:

the gray level drive step changes a display image by causing the particles to migrate within said gray level state to produce a display color differences;

the gray level drive step is initiated by an operation of an operating member held for a prescribed time to indicate a change display request;

a display redrawing process follows the gray level drive step if operation of the operating member that indicates a change display request is held during one display redrawing process in the gray level drive step; and control goes from the gray level drive step to the saturation drive step when the operation of the operating member during the one display redrawing process in the gray level drive step is released.

2. The drive method of claim 1, further comprising:

a saturation drive step of causing the particles to migrate to the saturation level state;

wherein particles currently maintained within said gray level state are driven to the saturation level state by executing the saturation drive step after the gray level drive step.

3. The drive method of claim 2, wherein a next display redrawing process is initiated by a change display request asserted in the saturation drive step.

4. The drive method of claim 2, wherein:

the gray level drive step starts at a prescribed time or when a prescribed condition is met; and control goes from the gray level drive step to the saturation drive step at a prescribed time or when a prescribed condition is met thereafter.

5. The drive method of claim 2, wherein:

at least one of a field application time in the gray level drive step and a field application time in the saturation drive step is adjusted according to a temperature when the display is driven.

6. The drive method of claim 1, wherein:

at least one of the gray level drive step and the saturation drive step applies a pulse that changes between a first potential and a second potential at one electrode, and applies either the first potential or second potential at another electrode according a desired display color, said first potential being different than said second potential.

7. The drive method of claim 1, wherein:

a current display redrawing process in progress is interrupted and a display redrawing process of the gray level drive step is executed when the operating member that asserts a change display request is operated for a shorter interval than the last time the operating member was operated and shorter than the saturation time required for one display redrawing process of the saturation drive step.

8. The drive method of claim 1, wherein:

a display redrawing process of the gray level drive step is sequentially executed the number of times the operating member is operated when operation of the operating member that asserts a change display request is repeated at a shorter interval than the saturation time required for one display redrawing process of the saturation drive step.

9. A display device that is driven by the drive method of claim 1.

10. The display device described in claim 9, wherein the display device is an electrophoretic display device.

11. A drive device for a display device that displays by causing charged particles to migrate by applying an electric field, comprising:

a gray level drive unit that causes the particles to migrate to, and be maintained within, a gray level state that is not a saturation level state, and creates an image by causing the particles to migrate within said gray level state to produce a display color difference, said saturation level state being a level at which migration of the particles is saturated;

a saturation drive unit that causes the particles to migrate to said saturation level state;

wherein the saturation drive unit executes a display redrawing process after a display redrawing process of the gray level drive unit to drive the particles in from the gray level state to the saturation level state;

an operation detection unit that detects operation of an operating member that asserts a change display request;

wherein the gray level drive unit executes a display redrawing process when the operation detection unit detects operation of the operating member for a prescribed time, and continues the display redrawing process if operation of the operating member is sustained during the display redrawing process; and the saturation drive unit executes another display redrawing process when operation of the operating member is cancelled during the display redrawing process of the gray level drive unit.

12. The drive device of claim 11, further comprising:

a power source;

a first potential generating unit that generates from the power source a first potential that is one of two different potentials;

a second potential generating unit that generates a second potential of the two different potentials from the power source; and a pulse generating unit that generates a pulse that changes between the first and second potentials.

13. The drive device of claim 11, further comprising:

a change display request generating unit that sends a change display request to either the gray level drive unit or the saturation drive unit during one display redrawing process of the saturation drive unit.

14. The drive device of claim 11, further comprising:

an operation detection unit that detects operation of an operating member that asserts a change display request;

wherein the gray level drive unit starts a display redrawing process when the operation detection unit detects operation of the operating member for a prescribed time.

15. The drive device of claim 11, further comprising:

an operation detection unit that detects operation of an operating member that asserts a change display request;

wherein the gray level drive unit interrupts a display redrawing process in progress and executes a next display redrawing process when the operation detection unit detects operation of the operating member at a shorter interval from the last time the operating member was operated than the saturation time required for one display redrawing process of the saturation drive unit.

16. The drive device of claim 11, further comprising:

an operation detection unit that detects operation of an operating member that asserts a change display request; and an operation count storage unit that stores an operation count when the operation detection unit detects operation of the operating member at a shorter interval than the saturation time required for one display redrawing process of the saturation drive unit;

wherein the gray level drive unit sequentially executes a display redrawing process a number of times based on the operation count stored by the operation count storage unit; and the operation count storage unit resets the stored operation count after the number of display redrawing processes executed by the gray level drive unit based on the operation count.

17. An electronic device comprising the drive device of claim 11.

18. A drive method for a display device that displays by causing charged particles to migrate by applying an electric field, comprising:

a gray level drive step of causing the particles to migrate to, and be maintained within, a gray level state that is not a saturation level state, said saturation level state being a level at which migration of the particles is saturated;

wherein:

the gray level drive step changes a display image by causing the particles to migrate within said gray level state to produce a display color difference;

the gray level drive step is initiated by an operation of an operating member held for a prescribed time to indicate a change display request; and a current display redrawing process in progress is interrupted and a display redrawing process of the gray level drive step is executed when the operating member that asserts a change display request is operated for a shorter interval than the last time the operating member was operated and shorter than the saturation time required for one display redrawing process of the saturation drive step.

19. A drive method for a display device that displays by causing charged particles to migrate by applying an electric field, comprising:

a gray level drive step of causing the particles to migrate to, and be maintained within, a gray level state that is not a saturation level state, said saturation level state being a level at which migration of the particles is saturated;

wherein:

the gray level drive step changes a display image by causing the particles to migrate within said gray level state to produce a display color difference;

the gray level drive step is initiated by an operation of an operating member held for a prescribed time to indicate a change display request; and a display redrawing process of the gray level drive step is sequentially executed the number of times the operating member is operated when operation of the operating member that asserts a change display request is repeated at a shorter interval than the saturation time required for one display redrawing Process of the saturation drive step.

20. A drive device for a display device that displays by causing charged particles to migrate by applying an electric field, comprising:

a gray level drive unit that causes the particles to migrate to, and be maintained within, a gray level state that is not a saturation level state, and creates an image by causing the particles to migrate within said gray level state to produce a display color difference, said saturation level state being a level at which migration of the particles is saturated;

a saturation drive unit that causes the particles to migrate to said saturation level state;

wherein the saturation drive unit executes a display redrawing process after a display redrawing process of the gray level drive unit to drive the particles in from the gray level state to the saturation level state;

an operation detection unit that detects operation of an operating member that asserts a change display request;

wherein the gray level drive unit interrupts a display redrawing process in progress and executes a next display redrawing process when the operation detection unit detects operation of the operating member at a shorter interval from the last time the operating member was operated than the saturation time required for one display redrawing process of the saturation drive unit.

21. A drive device for a display device that displays by causing charged particles to migrate by applying an electric field, comprising:

a gray level drive unit that causes the particles to migrate to, and be maintained within, a gray level state that is not a saturation level state, and creates an image by causing the particles to migrate within said gray level state to produce a display color difference, said saturation level state being a level at which migration of the particles is saturated;

a saturation drive unit that causes the particles to migrate to said saturation level state;

wherein the saturation drive unit executes a display redrawing process after a display redrawing process of the gray level drive unit to drive the particles in from the gray level state to the saturation level state;

an operation detection unit that detects operation of an operating member that asserts a change display request; and an operation count storage unit that stores an operation count when the operation detection unit detects operation of the operating member at a shorter interval than the saturation time required for one display redrawing process of the saturation drive unit;

wherein the gray level drive unit sequentially executes a display redrawing process a number of times based on the operation count stored by the operation count storage unit; and the operation count storage unit resets the stored operation count after the number of display redrawing processes executed by the gray level drive unit based on the operation count.

* * * * *